US011143989B2

(12) United States Patent
Ohta et al.

(10) Patent No.: US 11,143,989 B2
(45) Date of Patent: Oct. 12, 2021

(54) IMAGE FORMING APPARATUS

(71) Applicant: CANON KABUSHIKI KAISHA, Tokyo (JP)

(72) Inventors: Tetsuya Ohta, Abiko (JP); Yutaka Kakehi, Kashiwa (JP); Toshiyuki Yamada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/528,013

(22) Filed: Jul. 31, 2019

(65) Prior Publication Data

US 2020/0050133 A1 Feb. 13, 2020

(30) Foreign Application Priority Data

Aug. 9, 2018 (JP) ..... JP2018-150893
Nov. 15, 2018 (JP) ..... JP2018-215113

(51) Int. Cl.
*G03G 15/16* (2006.01)

(52) U.S. Cl.
CPC ..... *G03G 15/1665* (2013.01); *G03G 15/1605* (2013.01)

(58) Field of Classification Search
CPC ..... G03G 15/1605; G03G 15/1665; G03G 15/1675; G03G 15/5054; G03G 15/55; G03G 21/20
See application file for complete search history.

(56) References Cited

U.S. PATENT DOCUMENTS

| | | | | |
|---|---|---|---|---|
| 6,404,998 | B1 * | 6/2002 | Tanaka | G03G 15/1675 399/314 |
| 9,146,507 | B2 | 9/2015 | Mochizuki | |
| 9,454,109 | B2 | 9/2016 | Kojima et al. | |
| 9,557,695 | B2 | 1/2017 | Kojima et al. | |
| 9,841,707 | B2 | 12/2017 | Kuroda et al. | |
| 10,048,625 | B2 | 8/2018 | Ohta et al. | |
| 10,234,797 | B2 | 3/2019 | Aiba | |
| 2001/0021316 | A1 * | 9/2001 | Izawa | G03G 15/1675 399/66 |

(Continued)

FOREIGN PATENT DOCUMENTS

| | | |
|---|---|---|
| JP | 2004-053748 A | 2/2004 |
| JP | 2004-117920 A | 4/2004 |

(Continued)

OTHER PUBLICATIONS

Extended European Search Report dated Jan. 31, 2020, in European Patent Application No. 19190773.2.

*Primary Examiner* — David J Bolduc
(74) *Attorney, Agent, or Firm* — Venable LLP

(57) ABSTRACT

An image forming apparatus includes an image bearing member, a transfer member, a voltage source, a current detecting portion, a controller, and a receiving portion. During the recording material passing through the transfer portion, the controller controls a voltage applied to a transfer member on the basis of a detection result of the current detecting portion so that a current flowing through the transfer member falls within a predetermined range. The controller sets at least one of an upper limit and a lower limit of the predetermined range on the basis of a predetermined voltage changing instruction received by the receiving portion.

21 Claims, 21 Drawing Sheets

(56) References Cited

U.S. PATENT DOCUMENTS

2003/0103785 A1* 6/2003 Inukai ..... G03G 15/1675 399/314
2004/0062560 A1* 4/2004 Mochizuki ..... G03G 15/1635 399/49
2006/0013602 A1* 1/2006 Lee ..... G03G 15/2046 399/45
2007/0179737 A1* 8/2007 Kalokitis ..... G01C 7/04 702/150
2009/0196638 A1* 8/2009 Sukesako ..... G03G 15/0131 399/45
2010/0209128 A1* 8/2010 Sueoka ..... G03G 15/1605 399/66
2011/0069979 A1* 3/2011 Yamada ..... G03G 15/1605 399/44
2013/0004191 A1* 1/2013 Hayami ..... G03G 15/1675 399/66
2013/0195483 A1* 8/2013 Shimizu ..... G03G 15/1605 399/45
2013/0330096 A1* 12/2013 Mochizuki ..... G03G 15/1675 399/66
2014/0147137 A1* 5/2014 Miura ..... G03G 15/1675 399/45
2015/0016833 A1* 1/2015 Nakaegawa ..... G03G 15/1605 399/66
2015/0023679 A1* 1/2015 Nakaegawa ..... G03G 15/1605 399/66
2015/0277300 A1* 10/2015 Hironaka ..... G03G 15/1675 399/66
2015/0338785 A1 11/2015 Ai
2015/0362870 A1* 12/2015 Ogushi ..... G03G 15/1665 399/66
2016/0041510 A1* 2/2016 Kojima ..... G03G 15/1675 399/66
2016/0077468 A1* 3/2016 Kojima ..... G03G 15/1665 399/66
2016/0223956 A1* 8/2016 Nakaegawa ..... G03G 15/1605
2017/0176895 A1* 6/2017 Kuroda ..... G03G 15/1605
2018/0017904 A1 1/2018 Aiba
2018/0253039 A1 9/2018 Kakehi

FOREIGN PATENT DOCUMENTS

JP 4161005 B2 10/2008
JP 2008-275946 A 11/2008
JP 2010-145955 A 7/2010
JP 2013-254064 A 12/2013
JP 2017-116591 A 6/2017
JP 2018-010140 A 1/2018

* cited by examiner

| | AMBIENT WATER CONTENT (g/kg) | | | | | | |
|---|---|---|---|---|---|---|---|
| | ≤ 0.9 | 1.73 | 5.8 | 8.9 | 15 | 18.5 | 21.5 ≤ |
| Itarget(μA) | 60 | … | … | 40 | … | … | 25 |

FIG.12

| | | AMBIENT WATER CONTENT (g/kg) | | | | |
|---|---|---|---|---|---|---|
| | | ≤ 0.9 | ··· | 8.9 | ··· | 21.5 ≤ |
| BASIS WEIGHT ($g/m^2$) | ▪ | ▪ | | ▪ | | ▪ |
| | ▪ | ▪ | | ▪ | | ▪ |
| | 81～100 | 1000V | ··· | 500V | ··· | 200V |
| | 101～125 | 1150V | ··· | 600V | ··· | 250V |
| | 126～150 | 1300V | ··· | 700V | ··· | 300V |
| | ▪ | ▪ | | ▪ | | ▪ |
| | ▪ | ▪ | | ▪ | | ▪ |

FIG.13

| A4 SIZE | AMBIENT WATER CONTENT (g/kg) | | | | | | |
|---|---|---|---|---|---|---|---|
| | ≤ 0.9 | 1.73 | 5.8 | 8.9 | 15 | 18.5 | 21.5 ≤ |
| UPPER LIMIT (μA) | 70 | … | … | 50 | … | … | 35 |
| LOWER LIMIT (μA) | 50 | … | … | 30 | … | … | 15 |

FIG.14

IMAGE FORMING APPARATUS

FIELD OF THE INVENTION AND RELATED ART

The present invention relates to an image forming apparatus, such as a copying machine, a printer, a facsimile machine or a multi-function machine having a plurality of functions of these machines, and being of an electrophotographic type or an electrostatic recording type.

In the image forming apparatus of the electrophotographic type or the like, a toner image formed on a photosensitive member or an intermediary transfer belt as an image bearing member is transferred onto a recording material such as paper, so that an image is formed on the recording material. The transfer of the toner image from the image bearing member onto the recording material is carried out by applying a transfer bias to a transfer member for forming a transfer portion in contact with the image bearing member, for example. The transfer bias is in general subjected to constant-voltage control so that a predetermined voltage (target voltage) is applied to the transfer member or subjected to constant-current control so that a predetermined current (target current) flows through the transfer member.

In a constitution in which the transfer bias is subjected to the constant-current control, a current flowing through an outside of the recording material or a portion where the toner image is absent on the recording material causes a value of a current flowing through a portion where the toner image is present to be indefinite, so that a current with a proper value cannot readily be applied to the toner image. In a respect that satisfactory transfer can be carried out irrespective of an image to be formed, a constitution in which the transfer bias is subjected to constant-voltage control is advantageous. However, also in the case where the transfer bias is subjected to the constant-voltage control, in some situations, setting of the transfer bias is inappropriate, so that scattering of toner, image bleeding and image blur occur in some instances.

In the case where the transfer bias is subjected to the constant-voltage control, information on an electrical characteristic (electric resistance (value) or the like) of the transfer member is acquired when the recording material is absent at the transfer portion, such as during actuation of the image forming apparatus or before a start of continuous image formation. Then, on the basis of the information, a voltage value of the transfer bias applied in the constant-voltage control is set. However, the electric resistance of the transfer member gradually lowers by temperature rise during the image formation, and therefore, there is a possibility that the transfer bias which was appropriate immediately before the start of the continuous image formation gradually becomes inappropriate. Further, even when the recording materials of the same kind are used, electric resistances of the recording materials are different from each other in the case where a moisture-absorbing state varies for each of the recording materials or in the like case, so that there is a possibility that the transfer bias which was appropriate for a certain recording material becomes inappropriate for another recording material. Further, when a transfer current flowing through the transfer member during transfer is excessive, the toner scattering and the image bleeding occur in some instances. On the other hand, when the transfer current is insufficient, the image blur occurs in some instances due to improper transfer.

In order to solve such problems, Japanese Laid-Open Patent Application (JP-A) 2008-275946 proposes a constitution in which a transfer bias is subjected to constant-voltage control and in which an upper limit and a lower limit of a transfer current flowing through a transfer member are set. According to this constitution, it is possible to suppress an image defect due to deficiency or excess of the transfer current.

However, even when a predetermined range, i.e., the upper limit and the lower limit, of the transfer current are set, an operator such as a user or a service person intends to set a transfer bias in a region in which the transfer current is outside of the upper limit and the lower limit thereof in some cases.

As an example, FIG. 7 is a graph showing a relationship between the transfer current and an image rank when a secondary-color solid image and a halftone (HT) image are evaluated from the viewpoint of a toner application amount in the case where paper in a certain state is used as the recording material. As shown in FIG. 7, depending on the paper state or the like, in some cases, there is no transfer current setting range satisfying an image criterion (image rank 4) required from the viewpoint of the toner application amount with respect to both of the secondary-color solid image and the HT image. For example, in the case where the paper is extremely dried, when the transfer current is increased, electric discharge occurs in the paper and thus abnormal (electric) discharge image generates. The influence thereof is large on the HT image which is a portion where the toner application amount per unit area is small, and when the transfer current is increased, the image rank of the HT image becomes bad earlier than improvement of the image rank of the secondary-color solid image. On the other hand, with a larger toner application amount, a larger transfer current is needed to ensure a sufficient transferability, and therefore, the image rank of the secondary-color solid image becomes better with an increasing transfer current. Thus, in order to meet a situation that there is no transfer current setting range satisfying the image criterion (image rank 4) required for both of the HT image and the secondary-color solid image, setting of the lower limit of the transfer current at transfer current A indicated in FIG. 7 is one idea. When the transfer current lower limit is set in this manner, in the case where the above-described situation arises, with respect to both of the secondary-color solid image and the HT image, better image ranks can be achieved to the extent possible.

However, even in the above-described situation, there is also a case that depending on a user, importance is attached to a better image rank of the HT image, for example. In that case, it would be considered that the user or the service person changes (decreases) a target voltage of the transfer bias from an operating portion or the like so that a result desired by the user (service person) can be obtained. However, when the transfer current A is set as the transfer current lower limit, even in the case where the target voltage of the transfer bias is changed, a voltage value of the transfer bias cannot be changed to not more than the changed target voltage when the transfer current reaches the transfer current A during transfer, so that the image desired by the user cannot be outputted.

Thus, in the constitution in which the transfer bias is subjected to the constant-voltage control, even when the target voltage (or a target current) of the transfer bias is changed as desired by the user or the like, the target voltage is limited to the upper limit or the lower limit of the transfer current, so that a desired result cannot be obtained in some instances.

Similarly, in the case where the user attaches importance to the transferability, it would be considered that the target voltage of the transfer bias is increased. However, even when the target voltage of the transfer belt is changed, in the case where the transfer current reaches the upper limit during transfer, the voltage value of the transfer bias cannot be changed to not less than the changed target voltage, and therefore, the image desired by the user is not readily outputted.

Therefore, JP-A 2017-116591 proposes a constitution in which a transfer bias is subjected to constant-voltage control and in which an upper limit and a lower limit of a transfer current flowing through a transfer member is changeable from an operating portion. However, in the constitution of JP-A 2017-117691, a target voltage of the transfer bias during image formation is not directly changed. For this reason, the target voltage of the transfer bias is not changed until a transfer current during image formation is out of a range of the upper limit and the lower limit of the changed transfer current, so that an image desired by the user is not readily outputted.

SUMMARY OF THE INVENTION

A principal object of the present invention is to provide an image forming apparatus capable of changing an upper limit and a lower limit of a transfer current depending on a change in transfer voltage while enabling a change of setting of the transfer voltage from an operating portion in the case where the upper limit and the lower limit of the transfer current are set.

According to an aspect of the present invention, there is provided an image forming apparatus comprising: an image bearing member configured to bear a toner image; a transfer member provided in contact with the image bearing member and configured to transfer the toner image from the image bearing member onto a recording material at a transfer portion under application of a voltage thereto; a voltage source configured to apply the voltage to the transfer member; a current detecting portion configured to detect current information on a current flowing through the transfer member; a controller configured to carry out constant-voltage control so that the voltage applied to the transfer member is a predetermined voltage when the recording material passes through the transfer portion, wherein during the recording material being passing through the transfer portion, the controller controls the voltage applied to the transfer member on the basis of a detection result of the current detecting portion so that the current flowing through the transfer member falls within a predetermined range; and a receiving portion configured to receive an instruction to change the predetermined voltage from an operator, wherein the controller sets at least one of an upper limit and a lower limit of the predetermined range on the basis of the instruction received by the receiving portion.

According to another aspect of the present invention, there is provided an image forming apparatus comprising: an image bearing member configured to bear a toner image; a transfer member provided in contact with the image bearing member and configured to transfer the toner image from the image bearing member onto a recording material at a transfer portion under application of a voltage thereto; a voltage source configured to apply the voltage to the transfer member; a current detecting portion configured to detect information on a current flowing through the transfer member; and a controller configured to carry out constant voltage control so that the voltage applied to the transfer member is a predetermined voltage during the recording material being passing through the transfer portion, wherein during the recording material being passing through the transfer portion, the controller controls the voltage applied to the transfer member on the basis of a detection result of the current detecting portion so that the current flowing through the transfer member falls within a predetermined range; and wherein when the current flowing through the transfer member is out of the predetermined range during a first recording material being passing through the transfer portion in continuous image formation for continuously forming images on a plurality of recording materials, the controller changes, during the first recording material being passing through the transfer portion, the predetermined voltage applied to the transfer member, and the controller determines an initial value of the predetermined voltage for a second recording material to be passed after the first recording material, on the basis of the predetermined voltage changed during the first recording material being passing through the transfer portion.

Further features of the present invention will become apparent from the following description of exemplary embodiments with reference to the attached drawings.

BRIEF DESCRIPTION OF THE DRAWINGS

FIG. 12 is a table showing an example of table data of a target current.

FIG. 13 is a table showing an example of table data of a recording material sharing voltage.

FIG. 14 is a table showing an example of table data of a predetermined current range of a secondary transfer current.

DESCRIPTION OF EMBODIMENTS

An image forming apparatus according to the present invention will be specifically described with reference to the drawings.

[Embodiment 1]

1. General Constitution and Operation of Image Forming Apparatus

Figure 1:
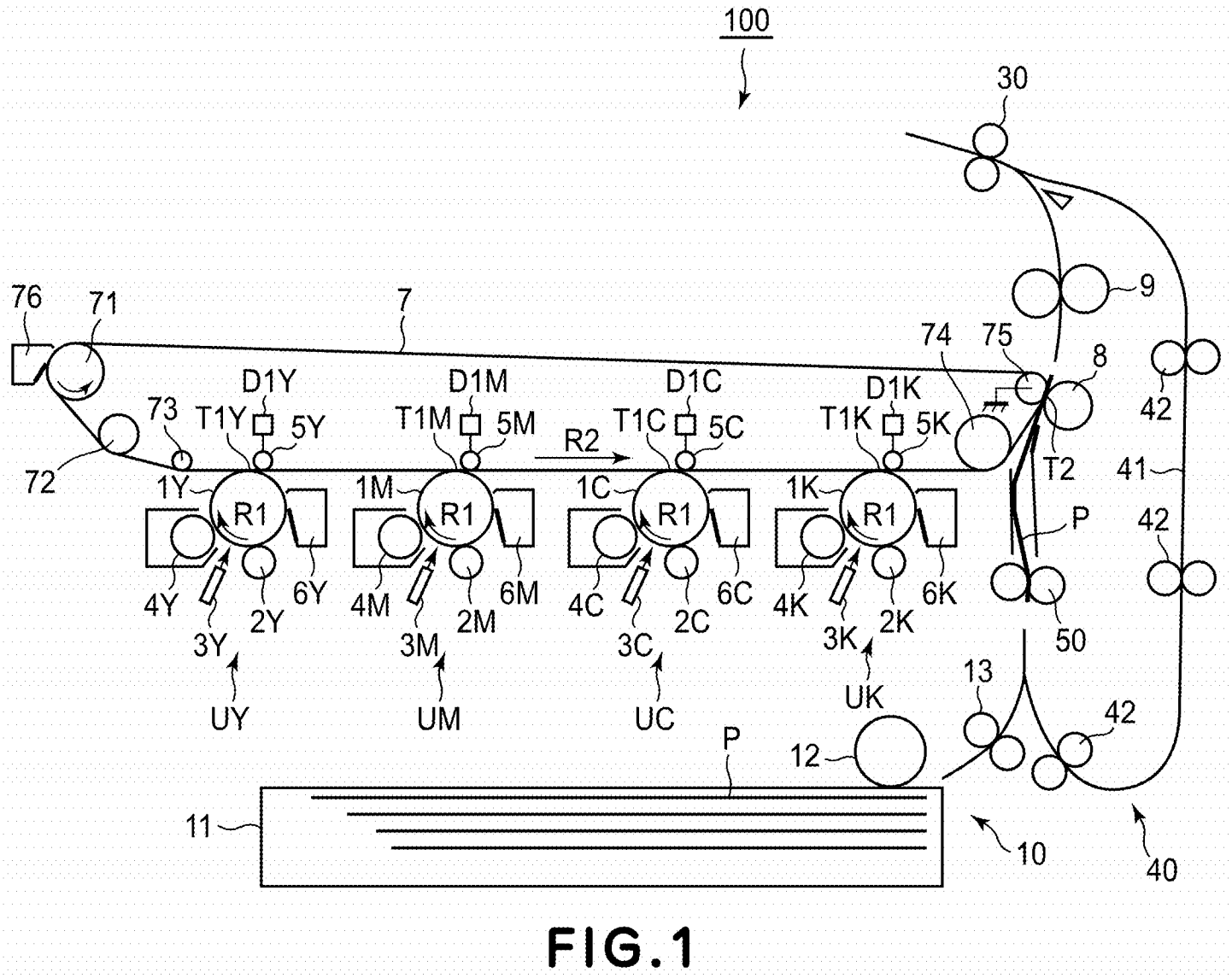
FIG. 1 is a schematic sectional view of an image forming apparatus.

FIG. 1 is a schematic sectional view of an image forming apparatus 100 of the present invention.

The image forming apparatus 100 in this embodiment is a tandem printer which is capable of forming a full-color image using an electrophotographic type and which employs an intermediary transfer type.

The image forming apparatus 100 includes four image forming units UY, UM, UC and UK for forming images of yellow (Y), magenta (M), cyan (C) and black (K). As regards elements of the respective image forming units UY, UM, UC and UK having the same or corresponding functions or constitutions, suffixes Y, M, C and K for representing the elements for associated colors are omitted, and the elements will be collectively described in some instances. The image forming unit U is constituted by including a photosensitive drum 1, a charging roller 2, an exposure device 3, a developing device 4, a primary transfer roller 5, a cleaning device 6 and the like, which are described later.

The image forming unit U includes the photosensitive drum 1 which is a rotatable drum-shaped photosensitive member (electrophotographic photosensitive member) as a first image bearing member for bearing a toner image. The photosensitive drum 1 is rotationally driven at a predetermined peripheral speed in an arrow R1 direction (clockwise direction). A surface of the rotating photosensitive drum 1 is electrically charged uniformly to a predetermined polarity (negative in this embodiment) and a predetermined potential by the charging roller 2 which is a roller-type charging member as a charging means. The charged surface of the photosensitive drum 1 is subjected to scanning exposure to light depending on image data (image information signal) by the exposure device (laser scanner) 3 as an exposure means, so that an electrostatic image (electrostatic latent image) depending on the image data is formed on the photosensitive drum 1. The electrostatic image formed on the photosensitive drum 1 is developed (visualized) by supplying toner as a developer by the developing device 4 as a developing means, so that a toner image (developer image) depending on the image data is formed on the photosensitive drum 1. In this embodiment, the toner charged to the same polarity as a charge polarity of the photosensitive drum 1 is deposited on an exposed portion (image portion) of the photosensitive drum 1 where an absolute value of the potential is lowered by exposing to light the surface of the photosensitive drum 1 after the photosensitive drum 1 is uniformly charged. In this embodiment, a normal charge polarity of toner which is a charge polarity of the toner during development is a negative polarity.

As a second image bearing member, for bearing the toner image, an intermediary transfer belt 7, which is a rotatable intermediary transfer member having an endless belt shape, is provided so as to oppose the four photosensitive drums 1. The intermediary transfer belt 7 is extended around and stretched by a plurality of stretching rollers (supporting rollers) including a driving roller 71, a tension roller 72, first and second idler rollers 73 and 74 and a secondary transfer opposite roller 75. The intermediary transfer belt 7 is constituted by a film-shaped endless belt formed of a material including a resin material, such as polyimide or polyamide, or various rubbers and including an electroconductive filler such as carbon black, an ion conductive material or the like, which are contained and dispersed in the resin material or in the various rubbers, for example. The intermediary transfer belt 7 is $1\times10^{9}$-$5\times10^{11}$ Ω/square in surface resistivity and is about 0.04-0.5 mm in thickness, for example. The driving roller 71 is driven by a motor excellent in constant-speed property and circulates and moves (rotates) the intermediary transfer belt 7. The tension roller 72 imparts a certain tension to the intermediary transfer belt 7. The idler rollers 73 and 74 support the intermediary transfer belt 7 extending along an arrangement direction of the photosensitive drums 1Y, 1M, 1C and 1K. The secondary transfer opposite roller 75 functions as an opposing member (opposing electrode) of a secondary transfer roller 8 (described later). The tension of the intermediary transfer belt 7 against the tension roller 72 is about 3-12 kgf. The intermediary transfer belt 7 is driven and circulated (rotationally driven) in an arrow R direction (counterclockwise direction) in FIG. 1 by the driving roller 71. On the inner peripheral surface side of the intermediary transfer belt 7, the primary transfer rollers 5, which are roller-type primary transfer members as primary transfer means, are disposed correspondingly to the respective photosensitive drums 1. In this embodiment, the primary transfer roller is constituted by a metal roller. The primary transfer roller 5 is urged toward an associated photosensitive drum 1 through the intermediary transfer belt 7, whereby a primary transfer portion (primary transfer nip) T1 where the photosensitive drum 1 and the intermediary transfer belt 7 contact each other is formed.

The toner image formed on the photosensitive drum 1 as described above is primary-transferred onto the rotating intermediary transfer belt 7 at the primary transfer portion T1 by the action of the primary transfer roller 5. During the primary transfer step, to the primary transfer roller 5, a primary transfer bias (primary transfer voltage) which is a DC voltage of an opposite polarity (positive in this embodiment) to a normal charge polarity of the toner is applied by a primary transfer voltage source (high voltage source) D1. For example, during full-color image formation, the color toner images of Y, M, C and K formed on the respective photosensitive drums 1 are successively primary-transferred superposedly onto the intermediary transfer belt 7 at the respective primary transfer portions T1.

Figure 2:
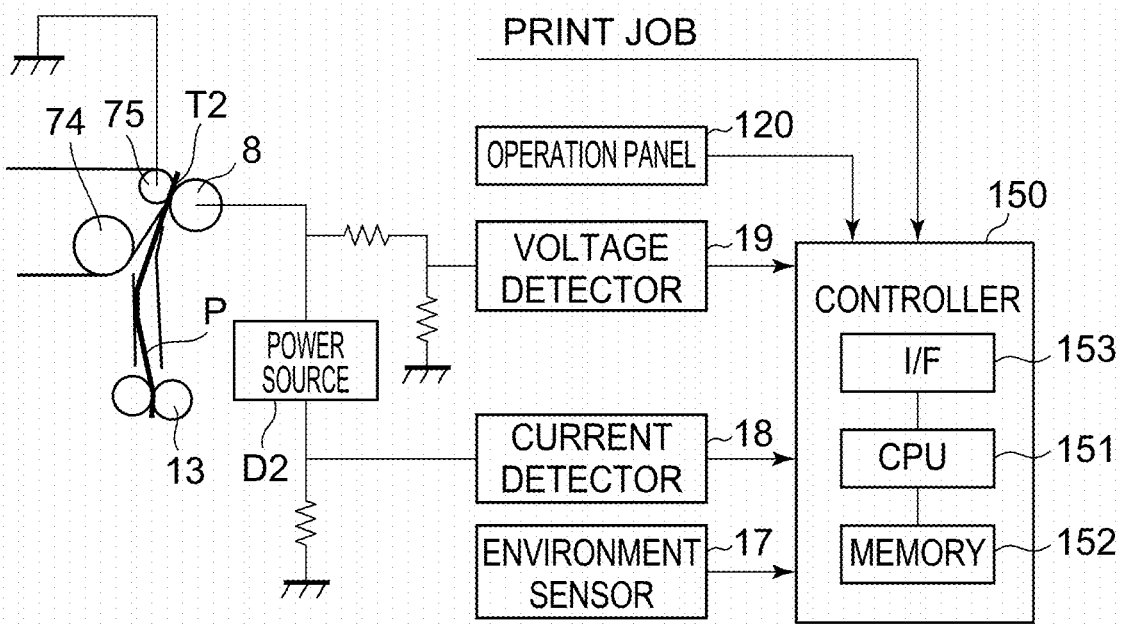
FIG. 2 is a schematic view for illustrating a structure of a secondary transfer portion.

On an outer peripheral surface side of the intermediary transfer belt 7, at a position opposing the secondary transfer opposite roller 75, the secondary transfer roller 8 which is a roller-type secondary transfer member as a secondary transfer means is provided. The secondary transfer roller 8 is urged toward the secondary transfer opposite roller 75 through the intermediary transfer belt 7 and forms a secondary transfer portion (secondary transfer nip) T2 where the intermediary transfer belt 7 and the secondary transfer roller 8 contact each other. The toner images formed on the intermediary transfer belt 7 as described above are secondary-transferred onto a recording material (recording medium, sheet) P such as paper sandwiched and fed by the intermediary transfer belt 7 and the secondary transfer roller 8 at the secondary transfer portion T2 by the action of the secondary transfer roller 8. During the secondary transfer step, to the secondary transfer roller 8, a secondary transfer bias which is a DC voltage of the opposite polarity to the normal charge polarity of the toner is applied by a secondary transfer voltage source (high voltage source) D2 (FIG. 2).

The recording material P is fed to the secondary transfer portion T2 by a recording material supplying device 10 as a recording material supplying portion. The recording material supplying device 10 includes a recording material accommodating portion (cassette, tray or the like) 11 for accommodating the recording material P, a pick-up roller 12 for feeding the recording material P one by one at predetermined timing, a feeding roller pair 13 for feeding the fed recording material P, and the like. The recording material P fed by the feeding roller pair 13 is fed toward the secondary transfer portion T2 by being timed to the toner images on the intermediary transfer belt 7 by a registration roller pair 50 as a registration correcting portion.

The recording material P on which the toner images are transferred is fed toward a fixing device 9 as a fixing means. The fixing device 9 heats and presses the recording material P carrying thereon unfixed toner images, and thus fixes (melt-fixes) the toner images on the recording material P. In the case where an image forming mode is a one-side mode (one-side printing) in which the image is formed on only one side (surface) of the recording material P, the recording material P on which the toner images are fixed on one side (surface) thereof is discharged (outputted) to an outside of an apparatus main assembly of the image forming apparatus 100 by a discharging roller pair 30 as a discharging portion.

In the case where the image forming mode is a double-side mode (automatic double-side printing) in which the images are formed on double (both) sides (surfaces) of the recording material P, the recording material P on which the image is formed (the toner image is fixed) on a first side (surface) is fed again to the secondary transfer portion T2 by a double-side feeding device 40. In the case of the double-side mode, the discharging roller pair 30 is reversed at predetermined timing before the recording material P on which the image is formed on the first side is discharged to the outside of the image forming apparatus. As a result, the recording material P is guided into a reverse path (double-side feeding path) 41 of the double-side feeding device 40. The recording material P guided into the reverse path 41 is fed toward the registration roller pair 50 by a reverse-feeding roller pair 42. Similarly as in the case of the image formation on the first side, this recording material P is fed to the secondary transfer portion T2 by being timed to the toner images on the intermediary transfer belt 7 by the registration roller pair 50, so that the toner images are secondary transferred onto a second side (surface) opposite from the first side. The recording material P on which the toner images are transferred on the second side is discharged to the outside of the image forming apparatus by the discharging roller pair 30 after the toner images are fixed on the second side of the recording material P by the fixing device 9.

Further, toner (primary transfer residual toner) remaining on the photosensitive drum 1 without being transferred onto the intermediary transfer belt 7 during the primary transfer step is removed and collected from the photosensitive drum 1 by a drum cleaning device 106 as a photosensitive member cleaning means. Further, on the outer peripheral surface side of the intermediary transfer belt 7, at a position opposing the driving roller 71, a belt cleaning device 76 as an intermediary transfer member cleaning means is provided. Toner (secondary transfer residual toner) remaining on the intermediary transfer belt 7 without being transferred onto the recording material P during the secondary transfer step, and paper powder are removed and collected from the surface of the intermediary transfer belt 7 by the belt cleaning device 76.

2. Secondary Transfer

FIG. 2 is an illustration of a constitution of the secondary transfer portion T2 of the image forming apparatus 100. The secondary transfer roller 8 is press-contacted to the intermediary transfer belt 7 supported at an inner surface by the secondary transfer opposite roller 75 connected to a ground potential, so that the secondary transfer portion T2 is formed between the intermediary transfer belt 7 and the secondary transfer roller 8. The secondary transfer portion T2 is formed by a cooperation between the secondary transfer opposite roller 75 and the secondary transfer roller 8. A transfer electric field is formed at the secondary transfer portion T2 by applying a positive(-polarity) DC voltage as a secondary transfer bias (secondary transfer voltage) from the secondary transfer voltage source D2 to the secondary transfer roller 8. As a result, the negative toner images carried on the intermediary transfer belt 7 are secondary-transferred onto the recording material P passing through the secondary transfer portion. In this embodiment, the case where the secondary transfer bias (secondary transfer voltage) is applied to the secondary transfer roller 8 was described, but the present invention is not limited thereto. For example, a constitution in which the secondary transfer bias (secondary transfer voltage) is applied to the secondary transfer opposite roller 75 may also be employed. In this case, a DC voltage of the same polarity as the normal charge polarity of the toner is applied to the secondary transfer opposite roller 75, and the secondary transfer roller 8 is connected to the ground potential.

The secondary transfer opposite roller 75 is constituted by forming a 2 mm-thick electroconductive rubber layer as an elastic layer on an outer peripheral surface of an aluminum pipe of 18 mm in diameter as a core metal (base material). In this embodiment, an outer diameter of the secondary transfer opposite roller 75 is 22 mm. As the electroconductive rubber, a rubber obtained by mixing an ion-conductive agent in a nitrile-butadiene rubber, an ethylene-propylene-diene rubber, a urethane rubber or the like is used. In this embodiment, an electric resistance (value) of the secondary transfer opposite roller 75 is adjusted to $1\times10^5$ Ω or less. Incidentally, this electric resistance was acquired from a current flowing through the secondary transfer opposite roller 75 when a voltage of 50 V was applied to a roller shaft (core metal) while rotating the secondary transfer opposite roller 75 by rotation of an electroconductive cylinder to which the secondary transfer opposite roller 75 was press-contacted under application of a load (pressure) of 10 N (1 kgf). Further, in this embodiment, surface hardness of the secondary transfer opposite roller 75 is 70 degrees in terms of an ASKER-C hardness value.

The secondary transfer roller 8 is constituted by forming a 6 mm-thick electroconductive rubber sponge as an elastic layer on an outer peripheral surface of a stainless steel roller shaft of 12 mm in diameter as a core metal (base material). In this embodiment, an outer diameter of the secondary transfer roller 8 is 24 mm. As the electroconductive rubber sponge, a rubber sponge which is obtained by mixing an ion-conductive agent in a nitrile-butadiene rubber, an ethylene-propylene-diene rubber, a urethane rubber or the like and which is adjusted so as to have an electric resistance of $1\times10^7$-$1\times10^8$ Ω is used. Incidentally, this electric resistance was acquired from a current flowing through the secondary transfer roller 8 when a voltage of 2 kV was applied to a roller shaft (core metal) while rotating the secondary transfer roller 8 by rotation of an electroconductive cylinder to which the secondary transfer roller 8 was press-contacted under application of a load (pressure) of 10 N (1 kgf). Further, in this embodiment, surface hardness of the secondary transfer roller 8 is 35 degrees in terms of the ASKER-C hardness value.

In FIG. 2, a control mode of a principal part of the image forming apparatus 100 in this embodiment is shown. A controller (DC controller) 150 is constituted by including a CPU 151 as a control means which is a dominant element for performing processing, and memories (storing media) 152 such as a ROM and a RAM which are used as storing means. In the RAM which is rewritable memory, information inputted to the controller 150, detected information, a calculation result and the like are stored. In the ROM, a data table acquired in advance and the like are stored. The CPU 151 and the memories 152 such as the ROM and the RAM are capable of transferring and reading the data therebetween. Further, the controller 150 is provided with a communicating portion (I/F) 153 for exchanging information with an external device (not shown) such as a personal computer. The CPU 151 is connected to the external device through the communicating portion 153 in a communicatable manner, and is capable of receiving data from the external device.

To the controller 150, the secondary transfer voltage source D2 is connected. The secondary transfer voltage source D2 is capable of applying a bias subjected to constant-voltage control with a predetermined target voltage and a bias subjected to constant-current control with a predetermined target current in a switching manner. The controller 150 controls the secondary transfer voltage source D2, so that a secondary transfer bias to be applied to the secondary transfer roller 8 during a secondary transfer step is set. Then, during the secondary transfer step, the controller 150 causes the secondary transfer voltage source D2 to output the secondary transfer bias to the secondary transfer roller 8. In this embodiment, the controller 150 is capable of carrying out constant-voltage control of the bias applied from the secondary transfer voltage source D2 to the secondary transfer roller 8 by controlling a voltage outputted from the secondary transfer voltage source D2 so that a voltage value detected by a voltage detecting circuit 19 (described later) is a predetermined voltage value. Further, the controller 150 is capable of carrying out constant current control of the bias applied from the secondary transfer voltage source D2 to the secondary transfer roller 8 by controlling a voltage outputted from the secondary transfer voltage source D2 so that a current value detected by a current detecting circuit 18 (described later) is a predetermined current value. Further, in this embodiment, as specifically described later, the controller 150 sets a target voltage of the secondary transfer bias during non-image formation before image formation, and subjects the secondary transfer bias to the constant-voltage control during the secondary transfer so that the secondary transfer voltage is kept substantially constant at the target voltage. Further, in this embodiment, in the case where a secondary transfer current is out of a predetermined range during the secondary transfer, the controller 150 controls the secondary transfer bias so that the secondary transfer current falls within the predetermined range.

To the controller 150, the current detecting circuit 18 as a current detecting means (current detecting portion) is connected. The current detecting circuit 18 detects a current which is outputted from the secondary transfer voltage source D2 to the secondary transfer roller 8 and which flows through the secondary transfer portion T2. The current detecting circuit 18 outputs an analog voltage of 0-5 V depending on a current value, and the analog voltage is AD-converted to an 8-bit digital signal and is calculated by the controller 150.

To the controller 150, the voltage detecting circuit 19 as a voltage detecting means (voltage detecting portion) is connected. The voltage detecting circuit 19 detects a voltage which is outputted from the secondary transfer voltage source D2 to the secondary transfer roller 8 and which flows through the secondary transfer portion T2. The voltage detecting circuit 19 outputs an analog voltage of 0-5 V depending on a voltage value, and the analog voltage is AD-converted to an 8-bit digital signal and is calculated by the controller 150.

To the controller 150, an environmental sensor 17 as an acquiring means (environment detecting means) for acquiring environmental information on at least one of a temperature and a humidity of at least one of an inside and an outside of the image forming apparatus 100 is connected. In this embodiment, the environmental sensor 17 detects the temperature and the humidity in a casing of the image forming apparatus 100. The information on the temperature and the humidity detected by the environmental sensor 17 is inputted to the controller 150.

Further, to the controller 150, an operating panel 120 as an operating portion is connected. The operating panel 120 is constituted by including a display portion as a display means for displaying information and an input portion as an input means for inputting the information to the controller 150. In this embodiment, the operating panel 120 includes a touch panel functioning as the display portion and the input portion. The operating panel 120 displays, for example, a selection screen of the recording material P for permitting input of setting of image formation and is capable of allowing an operator such as a user or a service person to select a kind of the recording material P used for image formation. Further, to the controller 150, information on a print job is inputted from an external device. The information on the print job includes image data and a control instruction of setting for image formation, such as data for designating the kind of the recording material P used for the image formation, for example. Particularly, in this embodiment, the operating panel 120 is capable of receiving, as setting for the image formation, setting of changing a target voltage value of the state to a new value. The setting of changing the target voltage value of the secondary transfer bias to the new value may also be included in information on the print job, and this information is received by the communicating portion 153 and is inputted to the CPU 151. In this embodiment, the operating panel 120 and the communicating portion 153 constitute a receiving portion for receiving an instruction to change the target voltage of the secondary transfer bias.

Incidentally, the print job refers to a series of operations in which an image or images are formed and outputted on a single or plurality of recording materials and which are started by a single start instruction. Further, the kind of the recording material P includes attributes based on general features such as plain paper, thick paper, thin paper, glossy paper and coated paper and includes arbitrary information capable of discriminating the recording material P, such as a maker, a brand, a product number, a basis weight, a thickness and a size.

The controller 150 discriminates an operation content of the operator at the operating panel 120 or the information on the print job from the external device, and thus discriminates the setting on the image formation, such as the kind of the recording material P used for the image formation. Particularly, in this embodiment, the controller 150 is capable of changing at least one of an upper limit and a lower limit of the secondary transfer current depending on the setting of changing the target value of the secondary transfer bias to the new value in the discriminated setting on the image formation.

3. Secondary Transfer Bias Control

Next, control of the secondary transfer bias in this embodiment will be further described specifically. In this embodiment, in the case where the target voltage of the secondary transfer bias is changed by the operator in the constitution in which the secondary transfer bias is subjected to the constant-voltage control, at least one of the upper limit and the lower limit of the secondary transfer current is changed.

<ATVC>

The electric resistance of the secondary transfer portion T2 varies depending on an environment (temperature, humidity), a deviation of an initial electric resistance of the transfer member or the like, an energization history, and the like. For that reason, in the case where the secondary transfer bias is subjected to the constant-voltage control, during non-image formation (before the secondary transfer step) before the image formation, ATVC (automatic transfer voltage control) for setting the target voltage of the secondary transfer bias is carried out. As during the non-image formation, it is possible to cite during pre-multi-rotation at the time of actuation of the image forming apparatus 100, during pre-rotation at the time of a start of the image forming operation, and the like. By carrying out the ATVC, it is possible to determine a sharing voltage Vb of the secondary transfer portion T2 during the non-image formation necessary to determine a voltage value of the secondary transfer bias to be applied in an initial stage of the secondary transfer step. Incidentally, during non-image formation refers to a time when there is no recording material P in the secondary transfer portion.

In the ATVC, during non-image formation (in which the secondary transfer roller 8 contacts the intermediary transfer belt 7), a bias subjected to constant-current control with a target current Itarget is applied to the secondary transfer roller 8 for a time corresponding to one-full-circumference of the secondary transfer roller 8. In this embodiment, the target current is set in advance depending on an environment (in this embodiment, an absolute humidity (water content) calculated on the basis of the temperature and the humidity) and the kind of the recording material P, and is stored, as a data table or the like, in the memory 152. The CPU 151 of the controller 150 calculates the absolute humidity on the basis of the temperature and the humidity which are detected by the environmental sensor 17. Further, the controller 150 discriminates the kind of the recording material P from the operation content in the operating portion 120 or the print job information inputted from the external device. Then, on the basis of the absolute humidity and the kind of the recording material P, the controller 150 determines the target current Itarget by making reference to the above-described data table. Then, the CPU 151 calculates an average of voltage values sampled by the voltage detecting circuit 19 during application of the bias, subjected to the constant-current control, to the secondary transfer portion T2. Then, the CPU 151 causes the memory 152 to store the average of the voltage values as Vb in the memory 152.

Incidentally, in the ATVC, a plurality (two or more, for example three) of voltages or currents are supplied from the secondary transfer voltage source D2 to the secondary transfer roller 8, and a relationship between the voltage and the current (voltage-current characteristic) is acquired, so that information on the electric resistance of the secondary transfer portion T2 may also be acquired. In this case, in the acquired relationship between the voltage and the current, it is possible to acquire a target voltage providing a target current.

<Setting Screen of Adjusting Value Vu of Target Voltage of Secondary Transfer Bias>

Figure 3:
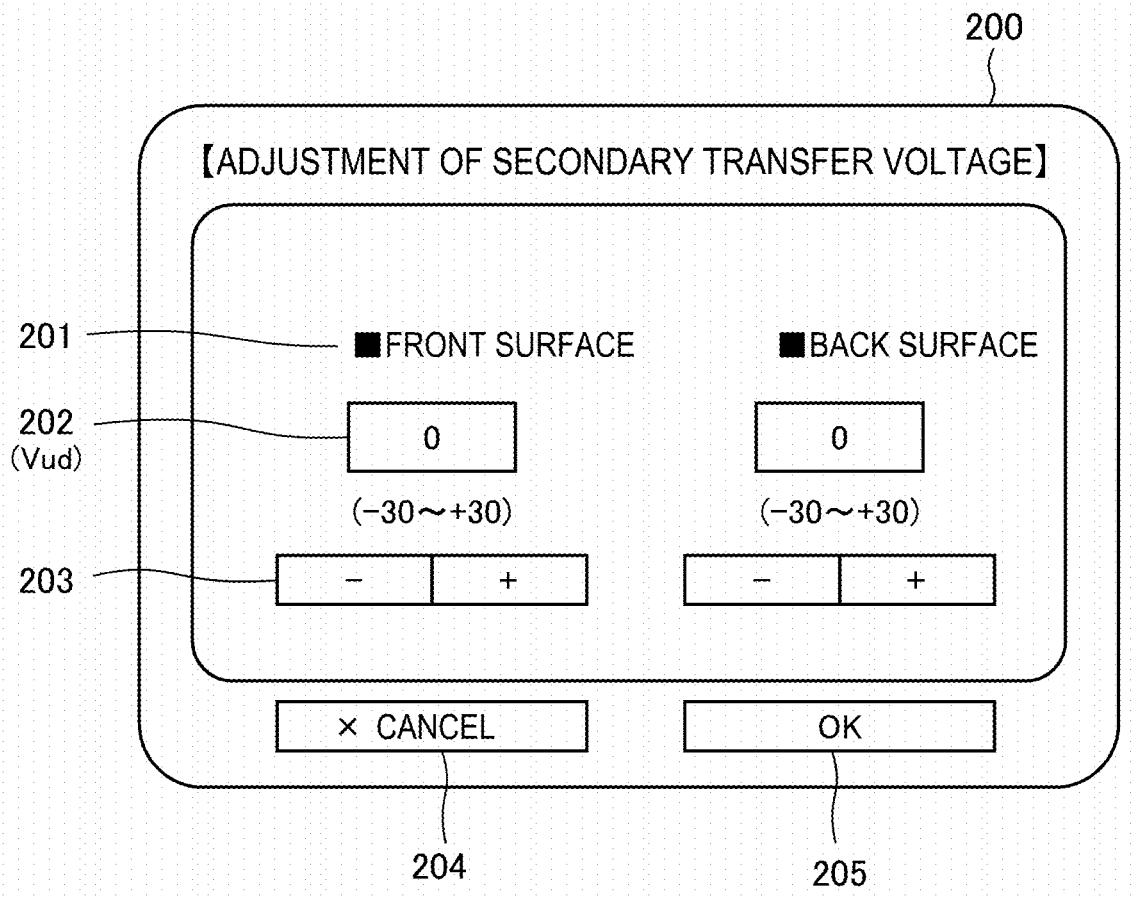
FIG. 3 is a schematic sectional view showing a setting screen of a target voltage of a secondary transfer bias.

FIG. 3 is a schematic view showing an example of a setting screen for receiving setting of an adjusting value Vu of the target voltage of the secondary transfer bias displayed on the operating panel 120.

In this embodiment, the adjusting value Vu is capable of being set for each kind of the recording material P. Further, in this embodiment, the adjusting values Vu can be independently set for a front surface (side) and a back surface (side) of each of the kinds of the recording materials P. Incidentally, the front surface refers to a surface on which the image is formed on the recording material P in the one-side mode and refers to a first surface (side) in the double-side mode. Further, the back surface refers to a second surface (side) in the double-side mode. FIG. 3 shows a setting screen 200, of the adjusting value Vu for a certain kind of the recording material P, displayed after the kind of the recording material P is selected on a screen (not shown) on which the kind of the recording material P for which setting of the adjusting value Vu is made.

The setting screen 200 is provided, as shown in a front and rear display portion 201, with a designation value display box 202 and designation value input buttons 203 for each of the front surface and the back surface of the recording material P. On the designation value display box 202, a designation value Vud corresponding to a present adjusting value Vu for the associated recording material P is displayed. This designation value Vud is 0 as default. When the adjustment of the target voltage of the secondary transfer bias was made in the past, the designation value Vud corresponding to the adjusting value Vu stored at that time is displayed. In this embodiment, the designation value Vud can be changed from −30 to +30, so that the adjusting value Vu can be changed by ±50 V for the designation value Vud of ±1. At every (one) selection of "−" of the designation value input button 203, the designation value Vud changes by −1. Further, at every (one) selection of "+" of the description value input button 203, the designation value Vud changes by +1. Further, by selecting the designation value display box 202 and then by inputting a value through numeric keys (not shown) provided on the operating panel 120, it is also possible to directly input the designation value Vud without operating the designation value input button 203. Incidentally, in this embodiment, for convenience during the adjustment by the operator, the designation value Vud corresponding to the adjusting value Vu was used, but the adjusting value Vu may also be directly designated on the setting screen.

The setting screen 200 is provided with a cancel button 204 and an OK button 205. When the OK button 205 is selected after the input of the designation value Vud is ended, the adjusting value Vu corresponding to the inputted designation value Vud is stored in the memory 152 of the controller 150. On the other hand, when the cancel button 204 is selected, the designation value Vud currently inputted is canceled and the last stored adjusting value Vu in the memory 152 is retained.

Incidentally, in this embodiment, the case where the setting of the adjusting value Vu is made by the operating panel 120 was described, but the setting of the adjusting value Vu is not limited to the setting on the operating panel 120. For example, the setting information may also be included in information on the print job inputted from the external device to the controller 150. In that case, a setting screen similar to, for example, the setting screen of FIG. 3 is displayed by a printer driver installed in the external device, and the operator may only be required to make setting through an operating portion of the external device in accordance with the setting screen.

<Setting Control of Upper Limit and Lower Limit of Secondary Transfer Current>

Figure 4:
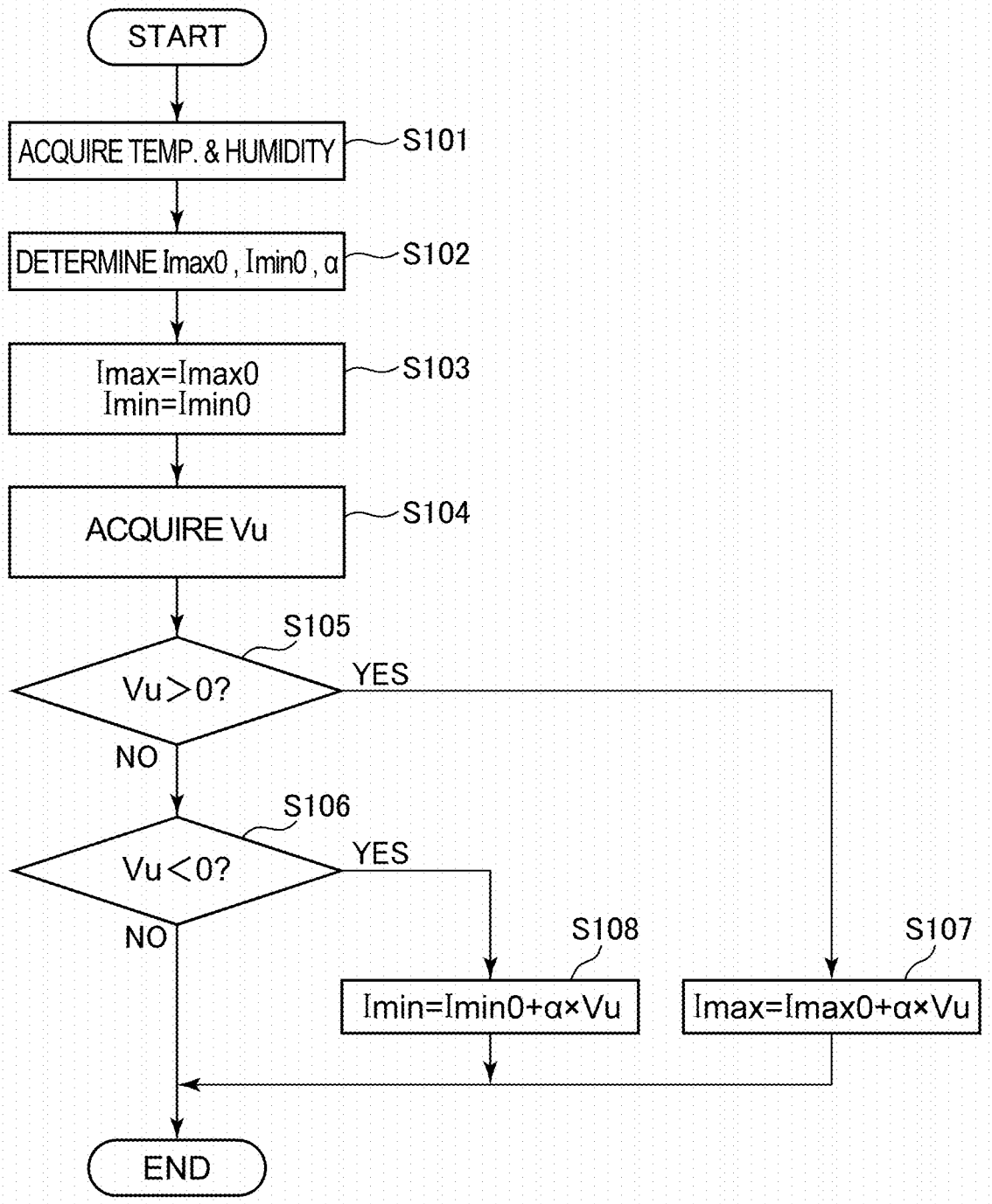
FIG. 4 is a flowchart of setting control of an upper limit and a lower limit of a secondary transfer current.

FIG. 4 is a flowchart of control for setting an upper limit Imax and a lower limit Imin of the secondary transfer current. The upper limit Imax and the lower limit Imin are, as specifically described later, needed when the secondary transfer bias is controlled depending on the secondary transfer current during the secondary transfer step.

First, when the CPU 151 of the controller 150 starts the setting control of the upper limit Imax and the lower limit Imin of the secondary transfer current, the CPU 151 acquires information on a temperature and a humidity from the environmental sensor 17 and calculates an absolute humidity (S101). Then, the CPU 151 determines an initial value Imax [mA] of the upper limit Imax, an initial value Imin0 [μA] of the lower limit Imin, and a conversion efficiency α [μA/V] (S102). In this embodiment, Imax0=60 μA and Imin0=40 μA are set. The values of Imax0 and Imin0 may also be changed depending on a kind and a size of the recording material P, an environment (at least one of the temperature and the humidity), an operation history of the image forming apparatus 100, or the like. Further, in this embodiment, the conversion efficiency α is set, on the basis of Table 1 below, depending on a value of an absolute humidity (water content) [g/m$^3$] calculated in S101. The value of Imax0 and Imin0 and information (data table or the like) indicating a relationship between the absolute humidity and the conversion efficiency α are stored in the memory 152 in advance.

TABLE 1

| Absolute humidity [g/m$^3$] | 0≤ and <6 | 6≤ and <16 | 16≤ |
|---|---|---|---|
| a [μA/V] | 0.01 | 0.02 | 0.03 |

Then, the CPU 151 sets the upper limit Imax and the lower limit Imin at Imax0 and Imin0, respectively, and causes the memory 152 of the controller 150 to store Imax0 and Imin0. Then, the CPU 151 acquires an adjusting value Vu of the target voltage of the secondary transfer bias which is set using the setting screen 200 for the adjusting voltage Vu described above and which is stored in the memory 152 (S104). Then, the CPU 151 discriminates whether or not the adjusting value is larger than 0 and whether or not the adjusting value is less than 0 (S105, S106). In the case of Vu>0 (YES of S105), the CPU 151 calculates a new upper limit Imax by the following formula: Imax0+α×Vu and thus renews and stores the upper limit Imax in the memory 152 (S107). In this case, the new upper limit Imax (absolute value) is larger than an initial value Imax0 (absolute value). In the case of Vu<0 (YES of S106), the CPU 151 calculates a new lower limit Imin from the following formula: Imin0+α×Vu and thus renews and stores the lower limit Imin in the memory 152 (S108). In this case, the new lower limit Imin (absolute value) is smaller than an initial value Imin0 (absolute value). Thereafter, the CPU 151 ends the setting control of the upper limit Imax and the lower limit Imin. Incidentally, in the case where the target voltage of the secondary transfer bias is not changed from a default (value), i.e., in the case of Vu=0 (NO of S105 and NO of S106), the upper limit Imax and the lower limit Imin are not changed.

In this embodiment, change amounts of the upper limit Imax and the lower limit Imin are changed depending on a change amount (adjusting amount Vu) of the target voltage of the secondary transfer bias. That is, in this embodiment, the change amounts of the upper limit Imax and the lower limit Imin are larger in the case where the change amount of the secondary transfer bias is a second value larger than a first value than in the case where the change amount of the secondary transfer bias is the first value. As a result, depending on the change amount of the target voltage of the secondary transfer bias, the secondary transfer current is more properly limited to the upper limit and the lower limit, so that it is possible to suppress that the change of the target voltage of the secondary transfer bias is not reflected as desired.

Further, in this embodiment, the change amounts of the upper limit Imax and the lower limit Imin are changed depending on the absolute humidity by changing the conversion efficiency α depending on the absolute humidity in accordance with Table 1. In this embodiment, in the case of relatively high temperature and high humidity, change amounts of the upper limit Imax and the lower limit Imin per unit change amount of the target voltage of the secondary transfer bias are made larger than those in the case of relatively low temperature and low humidity. That is, in this embodiment, the change amounts of the upper limit Imax and the lower limit Imin are larger in the case where the absolute humidity is a second value (for example 16 g/m$^3$ in Table 1) larger than a first value (for example 0 g/m$^3$ in Table 1) than in the case the absolute humidity is the first value. In the case where the absolute humidity is relatively large, a degree of the change in current relative to the change in voltage value of the secondary transfer bias is larger than that in the case where the absolute humidity is relatively small. For this reason, by setting the change amounts of the upper limit Imax and the lower limit Imin depending on the absolute humidity as described above, it is possible to more reliably suppress that the secondary transfer current is out of the upper limit and the lower limit and the change in target voltage of the secondary transfer bias is not reflected as desired.

In this embodiment, the change amounts (change ranges) of the upper limit Imax and the lower limit Imin were changed depending on the absolute humidity, but the present invention is not limited thereto. The change amounts of the upper limit Imax and the lower limit Imin can be determined depending on at least one of the temperature and the humidity (relative humidity or the like). Further, the change amounts of the upper limit Imax and the lower limit Imin may also be determined on the basis of information on the electric resistance of the secondary transfer roller 8. The electric resistance of the secondary transfer roller 8 correlates with at least one of the temperature and the humidity (typically, the electric resistance is higher in the case of the relatively low temperature and low humidity than in the case of the relatively high temperature and high humidity). For that reason, in place of the environment (at least one of the temperature and the humidity), information (resistance information) on the electric resistance of the secondary transfer roller 8 can be used. In this case, typically, the change amounts of the upper limit Imax and the lower limit Imin are made larger in the case where the electric resistance of the second transfer roller 8 is a second value larger than a first value than in the case where the electric resistance is the first value. As this information on the electric resistance of the secondary transfer roller 8, for example, the sharing voltage Vb of the secondary transfer portion T2 acquired in the ATVC can be used. That is, the upper limit Imax and the lower limit Imin can be changed depending on the sharing voltage Vb of the secondary transfer portion T2. In this case, typically, the change amounts of the upper limit Imax and the lower limit Imin are made larger in the case where the sharing voltage Vb of the secondary transfer portion T2 is a second value smaller than a first value than in the case where the sharing voltage Vb is the first value.

Further, in this embodiment, in the case where the target voltage (absolute value) of the secondary transfer bias is changed in an increasing direction, only the upper limit (absolute value) of the secondary transfer current is changed in an increasing direction, and the lower limit (absolute value) is not changed and is maintained. As another method, in the case where the target voltage (absolute value) of the secondary transfer bias is changed in the increasing direction, not only the upper limit (absolute value) but also the lower limit (absolute value) may also be changed in the increasing direction. In this case, the change amount of the lower limit can be typically made equal to the change amount of the upper limit.

Further, in this embodiment, in the case where the target voltage (absolute value) of the secondary transfer bias is changed in an increasing direction, only the lower limit (absolute value) of the secondary transfer current is changed in a decreasing direction, and the upper limit (absolute value) is not changed and is maintained. As another method, in the case where the target voltage (absolute value) of the secondary transfer bias is changed in the decreasing direction, not only the lower limit (absolute value) but also the upper limit (absolute value) may also be changed in the decreasing direction. In this case, the change amount of the lower limit can be typically made equal to the change amount of the upper limit. As a result, the function, of the upper limit and the lower limit, of suppressing not only that the change of the target voltage of the secondary transfer bias is not reflected as desired but also that the secondary transfer current becomes excessive or insufficient due to a deviation of the electric resistance of the recording material P or the like is readily maintained.

Further, in this embodiment, both the upper limit and the lower limit of the secondary transfer current are set, but the present invention is not limited thereto, and a constitution in which at least one of the upper limit and the lower limit of the secondary transfer current is set may only be employed. For example, in the case where only the upper limit of the secondary transfer current is set, the upper limit (absolute value) of the secondary transfer bias can be changed in an increasing direction only when the target voltage (absolute value) of the secondary transfer bias is changed in an increasing direction. Further, in the case where only the lower limit of the secondary transfer current is set, the lower limit (absolute value) of the secondary transfer bias can be changed in a decreasing direction only when the target voltage (absolute value) of the secondary transfer bias is changed in a decreasing direction.

<Control Flow of Secondary Transfer Bias>

Figure 5:
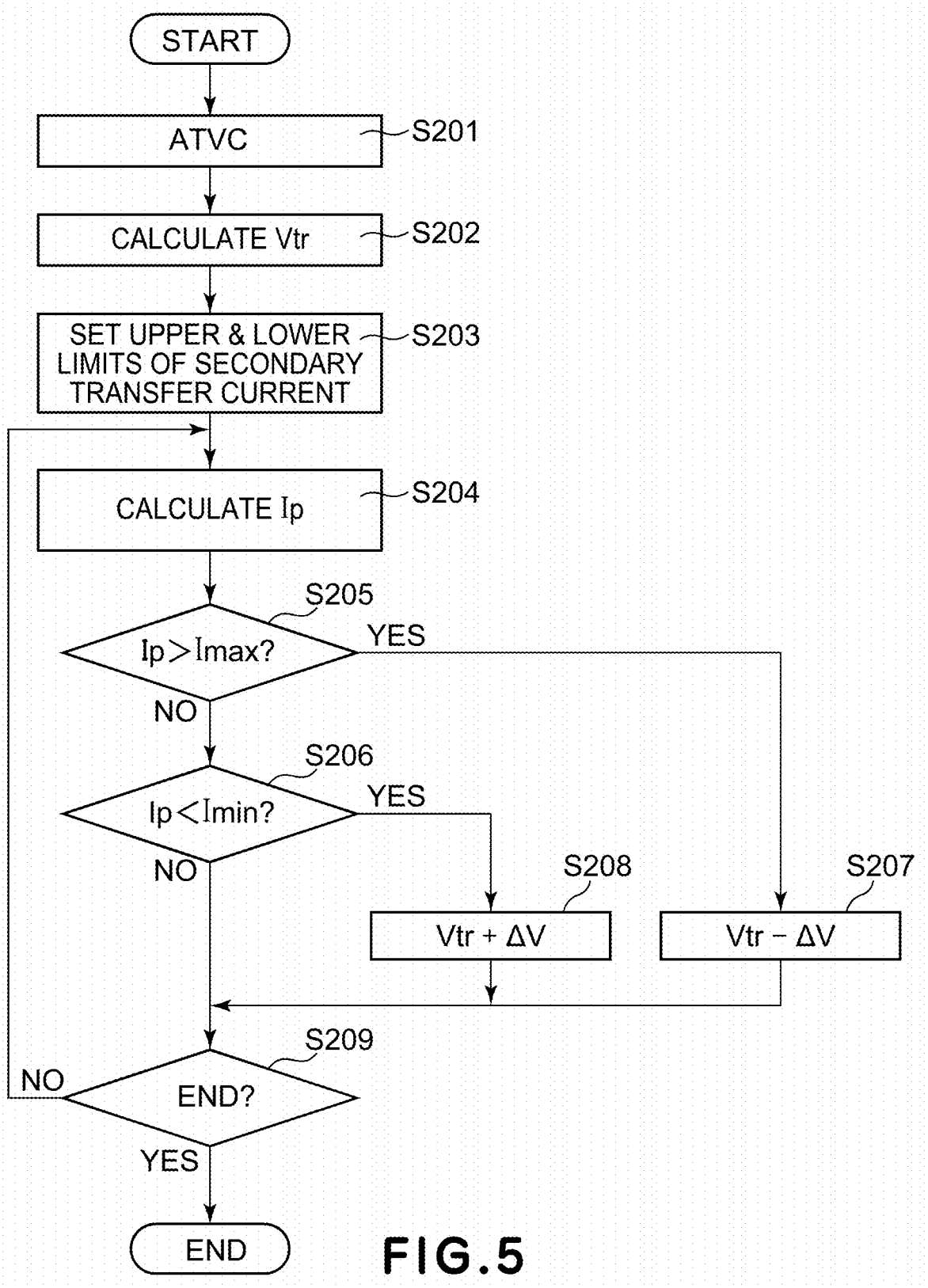
FIG. 5 is a flowchart of control of a secondary transfer bias in a print job.

FIG. 5 is a flowchart of control of the secondary transfer bias from a start of the print job in this embodiment.

First, when the print job is started, the CPU 151 of the controller 150 causes the image forming apparatus to execute the above-described ATVC before the recording material P reaches the secondary transfer portion T2 and thus determines the sharing voltage Vb of the secondary transfer portion T2 during non-sheet passing (S201). Then, the CPU 151 calculates an initial value of a target voltage Vtr of the secondary transfer bias (S202). The initial value of the target voltage Vtr is a voltage Vb +Vp +Va which is the sum of the sharing voltage Vb of the recording material P, a recording material sharing voltage Vp and the adjusting voltage Vu of the secondary transfer voltage. Here, the recording material sharing voltage Vp is a sharing voltage value of the recording material P in the secondary transfer portion T2. In this embodiment, the recording material sharing voltage Vp is a constant determined by an environment (absolute humidity calculated on the basis of the temperature and the humidity in this embodiment) and the kind of the recording material P. Information on this recording material sharing voltage Vp is set in advance and is stored as a data table or the like in the memory 152. Then, the CPU 151 sets the upper limit Imax and the lower limit Imin of the secondary transfer current as described with reference to FIG. 4 (S203). The above operation is performed before the recording material P reaches the secondary transfer portion T2. Then, the CPU 151 causes the voltage source to start application of the secondary transfer bias subjected to the constant-voltage control with the initial value of the target voltage Vtr calculated in S201 by being timed to arrival of a leading end of a first recording material P (first sheet) with respect to a recording material feeding direction at the secondary transfer portion T2.

The CPU 151 calculates a sheet-passing-portion current Ip in a period (measuring period) from after the leading end of the recording material P with respect to the recording material feeding direction reaches the secondary transfer portion T2 and sufficiently moves in the feeding direction until sufficiently before a trailing end of the recording material P with respect to the feeding direction comes out of the secondary transfer portion T2 (S204). In this embodiment, a position where the leading end of the recording material P sufficiently moved was a position of 10 mm from the secondary transfer portion T2 in which the leading end of the recording material P moved. Further, in this embodiment, a position sufficiently before the trailing end of the recording material P with respect to the feeding direction comes out of the secondary transfer portion T2 was a position of 10 mm in front of the secondary transfer portion T2. Here, the sheet-passing-portion current Ip is a current flowing through a portion, where the recording material P is present, of an entire region of the secondary transfer portion (a contact portion between the intermediary transfer belt 7 and the secondary transfer roller 8) T2 with respect to a direction substantially perpendicular to the feeding direction of the recording material P. A calculating method of the sheet-passing-portion current Ip is as follows. A current value detected by the current detecting circuit 18 is Itr, a dimension (length) of the secondary transfer roller 8 with respect to the direction substantially perpendicular to the recording material feeding direction is Ltr, and a dimension (length) of the recording material P with respect to the direction substantially perpendicular to the recording material feeding direction is Lp. At this time, the sheet-passing-portion current Ip is calculated by the following formula.

$$I_p = \frac{L_{tr}}{L_p} \times \left( I_{tr} - \frac{L_{tr} - L_p}{L_{tr}} \times I_{np} \right)$$

-continued $$\left(\because I_{tr} = \frac{L_p}{L_{tr}} \times I_p + \frac{L_{tr} - L_p}{L_{tr}} \times I_{np}\right)$$

Here, Inp in this formula is a current (non-sheet-passing-portion current) flowing through a portion, where the recording material P is absent, of the entire region of the secondary transfer portion T2 with respect to a longitudinal direction. The non-sheet-passing-portion current Inp is calculated by the following formula: Inp =Vtr (Vb/Itarget) by using an electric resistance (Vb/Itarget) of the secondary transfer portion T2 acquired in the ATVC. In order that the upper limit Imax and the lower limit Imin of the secondary transfer current normally act also in the case of a different width (length), as the sheet-passing-portion current Ip and the non-sheet-passing-portion current Inp in this embodiment, values normalized for a width Ltr of the secondary transfer roller 8 are used. Incidentally, the sheet-passing-portion current Ip can be acquired on the basis of an average of a plurality of current detection results in the above-described measuring period.

Then, the CPU 151 discriminates whether or not the sheet-passing-portion current Ip calculated in 5204 is larger than the upper limit Imax or whether or not the sheet-passing-portion current Ip is smaller than the lower limit Imin (S205, S206). In the case where the sheet-passing-portion current Ip is larger than the upper limit Imax (YES of S205), the CPU 151 decreases the target voltage Vtr by a voltage change range ΔV per (one) time and causes the memory 152 to store the decreased target voltage Vtr (S207). On the other hand, in the case where the sheet-passing-portion current Ip is smaller than the lower limit Imin (YES of S206), the CPU 151 increases the target voltage Vtr by the voltage change range ΔV per time and causes the memory 152 to store the increased target voltage Vtr (S208). In this embodiment, as the voltage change range ΔV per time, 50 V was used. The target voltage of the secondary transfer bias after this change is to be applied from during the secondary transfer of the images on a subsequent recording material P and later (typically from the subsequent recording material P). Incidentally, in the case where the sheet-passing-portion current Ip falls within a predetermined range, i.e., in the case where the sheet-passing-portion current Ip is the upper limit Imax or less (NO of S205) and is the lower limit Imin or more (NO of S206), the target voltage Vtr is not changed.

The CPU 151 discriminates whether or not image formation on all the pages of the print job is ended (S209). Further, in a period in which the print job is continued, the control in which the sheet-passing-portion current Ip is calculated using the newly set target voltage Vtr and then the target voltage is changed is repeated (S204 to S208). As a result, even in the case where the sheet-passing-portion current Ip is out of the upper limit Imax and the lower limit Imin in an initial stage, the sheet-passing-portion current Ip gradually approaches a range between the upper limit Imax and the lower limit Imin, and typically becomes the upper limit Imax or the lower limit Imin finally.

Thus, the image forming apparatus 100 of this embodiment includes the detecting portion 18 for detecting the current flowing through the transfer member 8 and includes the controller 150 for subjecting the voltage, applied to the transfer member 8 during the transfer, to the constant-voltage control so as to become a predetermined voltage (target voltage). This controller 150 is constituted so that during the transfer, in the case where an absolute value of the current detected by the detecting portion 18 is outside of the predetermined range, the voltage applied to the transfer member is adjusted so that the current flowing through the transfer member 8 falls within the predetermined range. Further, the image forming apparatus 100 of this embodiment includes a receiving portion for receiving an instruction to change the predetermined voltage by the operator. In this embodiment, this receiving portion is constituted by an operating portion (operating panel) 120 for receiving the instruction inputted by the operator or a communicating portion 153 for receiving an instruction inputted by the operator through an operating portion of the external device of the image forming apparatus 100. Further, in this embodiment, in the case where the receiving portion 120 or 153 receives an instruction to increase the absolute value of the predetermined voltage, the controller 150 increases at least one of the upper limit and the lower limit of the predetermined range. Further, in this embodiment, in the case where the receiving portion 120 or 153 receives an instruction to decrease the absolute value of the predetermined voltage, the controller 150 decreases at least one of the upper limit and the lower limit of the predetermined range. Particularly, in this embodiment, in the case where the receiving portion 120 or 153 receives the instruction to increase the absolute value of the predetermined range, the controller 150 increases the upper limit. However, in this case, the upper limit and the lower limit may also be increased. Further, in this embodiment, the controller 151 decreases the lower limit in the case where the receiving portion 120 or 153 receives the instruction to decrease the absolute value of the predetermined voltage. However, in this case, the upper limit and the lower limit may also be decreased. In this embodiment, the controller 150 is constituted so as to carry out a setting process (ATVC) for setting the predetermined voltage on the basis of a value of an output voltage of the voltage source D2 acquired by applying a voltage so that a predetermined current flows through the transfer member 8 when there is no recording material P at the transfer portion T2. Further, in this embodiment, in the case where the receiving portion 120 or 153 receives an instruction to change the predetermined voltage, the controller 150 changes the predetermined voltage set by the setting process.

As described above, according to this embodiment, in the constitution in which the upper limit and the lower limit of the secondary transfer current are set, in the case where the operator changes the target voltage of the secondary transfer bias, the upper limit and the lower limit of the secondary transfer current can be changed depending on the change of the target voltage of the secondary transfer bias. That is, according to this embodiment, in the case where the upper limit and the lower limit of the secondary transfer current are set, it is possible to suppress that the change in setting of the target voltage of the secondary transfer bias is not properly reflected by limitation of the upper limit and the lower limit. Further, according to this embodiment, in the case where the target voltage of the secondary transfer bias is changed, the upper limit and the lower limit are properly changed automatically, so that there is no need to separately set the upper limit and the lower limit of the secondary transfer current and thus it is possible to reduce an adjusting load of the operator.

[Embodiment 2]

Next, another embodiment of the present invention will be described. Basic constitutions and operations of an image forming apparatus in this embodiment are the same as those of the image forming apparatus of Embodiment 1. Accordingly, in the image forming apparatus of this embodiment, elements having the same or corresponding functions or constitutions as those in Embodiment 1 are represented by the same reference numerals or symbols as those in Embodiment 1 and will be omitted from detailed description.

In Embodiment 1, in the constitution in which the secondary transfer bias is subjected to the constant-voltage control, the case where the target voltage of the secondary transfer bias was directly changed by the operator was described. In this embodiment, in the constitution in which the secondary transfer bias is subjected to the constant-voltage control, the case where a target current for setting the target voltage of the secondary transfer bias is changed by the operator will be described. Also in this embodiment, the target voltage of the secondary transfer bias is consequently changed by changing the target current for setting the target voltage of the secondary transfer bias.

<Setting Screen of Secondary Transfer Target Current Itarget>

Figure 6:
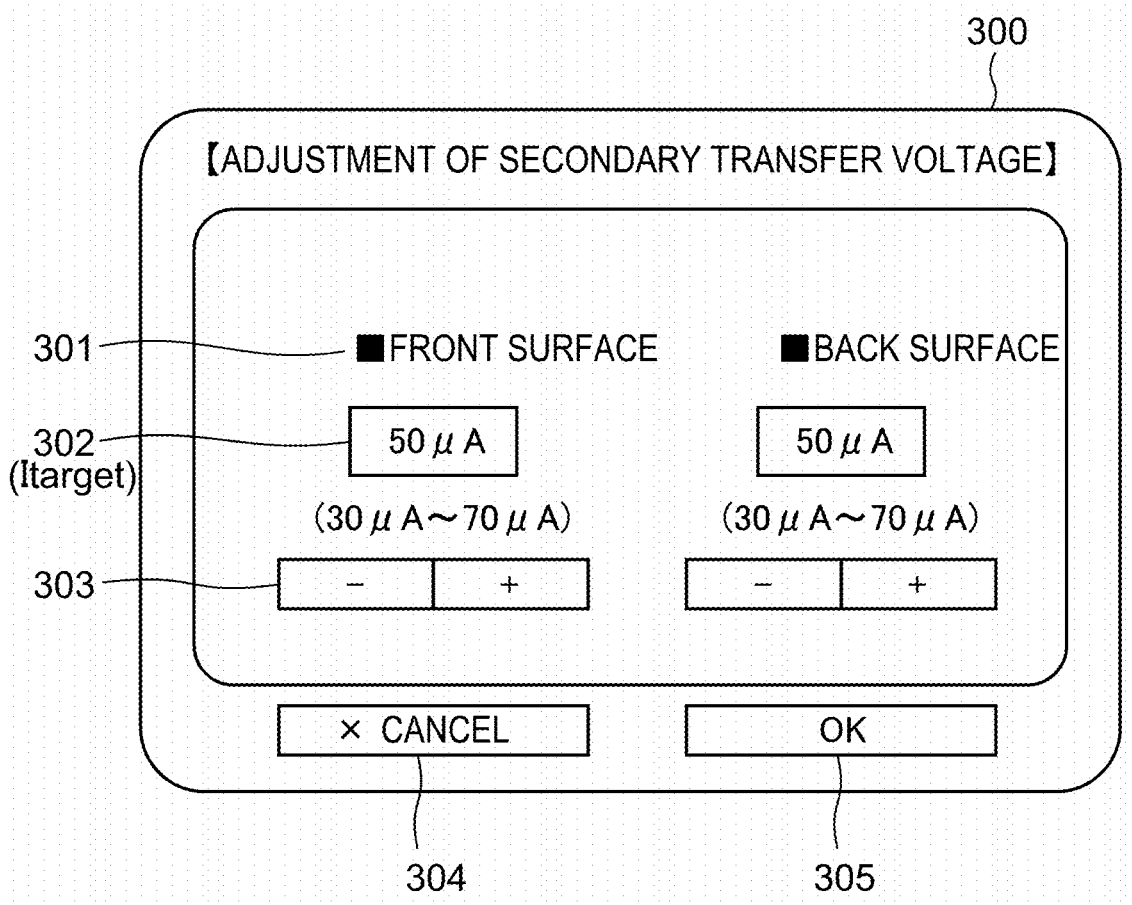
FIG. 6 is a schematic view showing a relationship between the penetration amount and a rank of transfer void.
Figure 7:
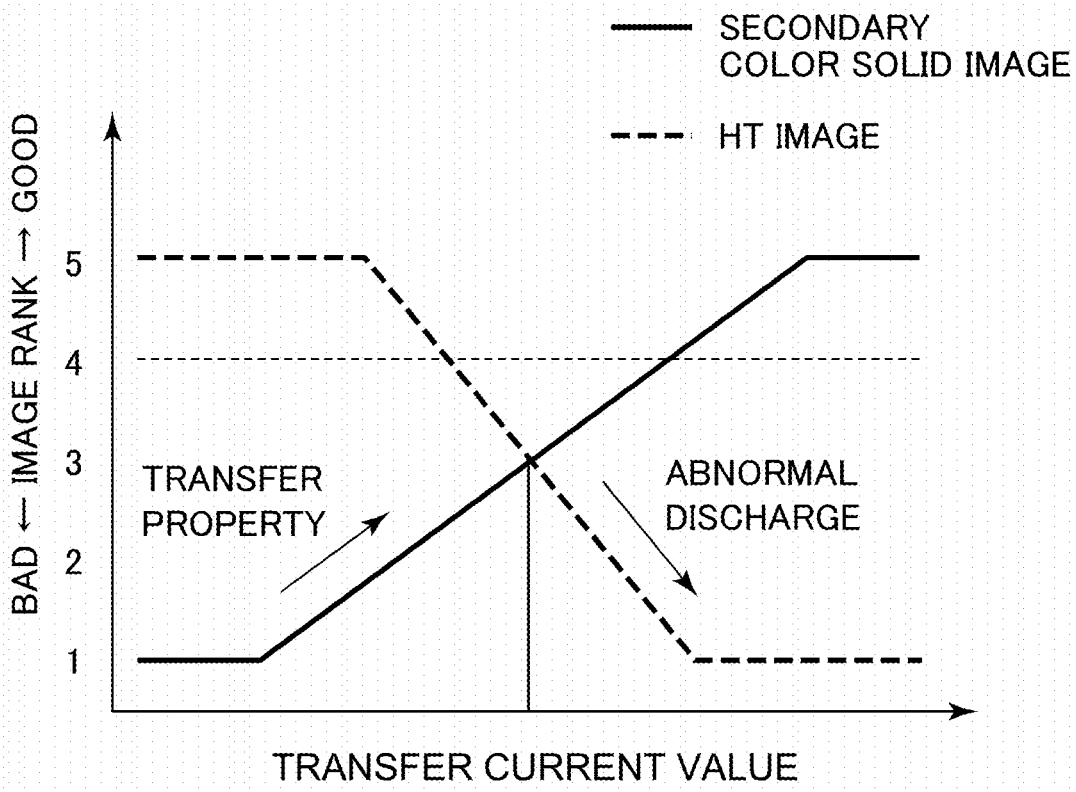
FIG. 7 is a graph for illustrating a problem.

FIG. 6 is a schematic view showing an example of a setting screen, for receiving setting of a target current Itarget of the secondary transfer bias, displayed on the operating panel 120.

In this embodiment, the target current Itarget can be set for each of kinds of recording materials P. Further, in this embodiment, the target current Itarget can be independently set for each of a front surface (side) and a back surface (side) of each of the kinds of the recording materials P. FIG. 6 shows a setting screen 300, of the target current Itarget for a certain kind of the recording material P, displayed after the kind of the recording material is selected on a screen (not shown) where setting of the target current Itarget is carried out and the kind of the recording material is selected.

The setting screen 300 is provided with a target current box 302 and a target current input button 303 for each of the front surface and the rear surface as shown at a front and rear display portion 301. In the target current box 302, a setting value of a present target current Itarget for the associated recording material P is displayed. An example of the setting value of this target current Itarget is 50 μA as default. When the adjustment is performed in the past, a setting value of the target current Itarget stored at that time is displayed. In this embodiment, the setting value of the target current Itarget can be changed in a range of 30 μA to 70 μA. At every (one) selection of "−" of the target current input button 303, the setting value of the target current Itarget is changed by −1 μA. Further, at every selection of "+" of the target current input button 303, the setting value of the target current Itarget is changed by +1 μA. Further, by selecting the target current box 302 and by inputting a target current value through numeric keys (not shown) provided on the operating panel 120, the target current Itarget can also be changed without operating the target change input button 303.

In this embodiment, the ATVC is carried out using the target current Itarget set as described above.

<Setting Control of Upper Limit and Lower Limit of Secondary Transfer Current>

Next, a method of setting the upper limit Imax and the lower limit Imin of the secondary transfer current in this embodiment will be described.

A change amount of the setting value of the target current of the secondary transfer bias from the default is ΔItarget. That is, ΔItarget=Itarget−(default Itarget). Here, the target current Itarget is the current value set as described above.

In this embodiment, the upper limit Imax and the lower limit Imin of the default secondary transfer current in the case where the target current Itarget is not changed are Imax0=60 μA and Imin0=40 μA. Further, in this embodiment, the upper limit Imax and the lower limit Imin are calculated by the following formula from the target current Itarget set as described above.

$$I_{max}=I_{max\ 0}+\Delta I_{target},\ I_{min}=I_{min\ 0}+\Delta I_{target}$$

Incidentally, a control flow itself of the secondary transfer bias in this embodiment is the same as the control flow described in Embodiment 1 with reference to FIG. 5. However, in this embodiment, in the ATVC of S201, the target current Itarget set as described above is used. Further, in this embodiment, setting of the upper limit Imax and the lower limit Imin of the secondary transfer current in S203 is made using the above formula on the basis of the above-described change amount Δ Itarget.

As described above, in this embodiment, in the case where the receiving portion 120 or 153 receives the instruction to change the target voltage of the secondary transfer bias, the controller 150 changes the predetermined current (target current) in the setting control (ATVC) of the target voltage. Thus, an effect similar to the effect of Embodiment 1 can be obtained also by changing the target current for setting the target voltage of the secondary transfer bias.

(Other Embodiments)

The present invention was described above based on specific embodiments, but is not limited thereto.

In the above-described embodiments, the image forming apparatus was the tandem image forming apparatus of the intermediary transfer type, but the present invention is also applicable to a monochromatic image forming apparatus including only one image forming portion. In this case, the present invention is applied to a transfer bias to be applied to a transfer member such as a transfer roller contacting an image bearing member such as a photosensitive drum.

[Embodiment 3]

Next, another embodiment of the present invention will be described. Basic constitutions and operations of an image forming apparatus in this embodiment are the same as those of the image forming apparatus in Embodiment 1. Accordingly, elements having the same or corresponding functions or constitutions are represented by the same reference numerals or symbols as those in Embodiment 1 and will be omitted from detailed description.

1. General Constitution and Operation of Image Forming Apparatus

Figure 8:
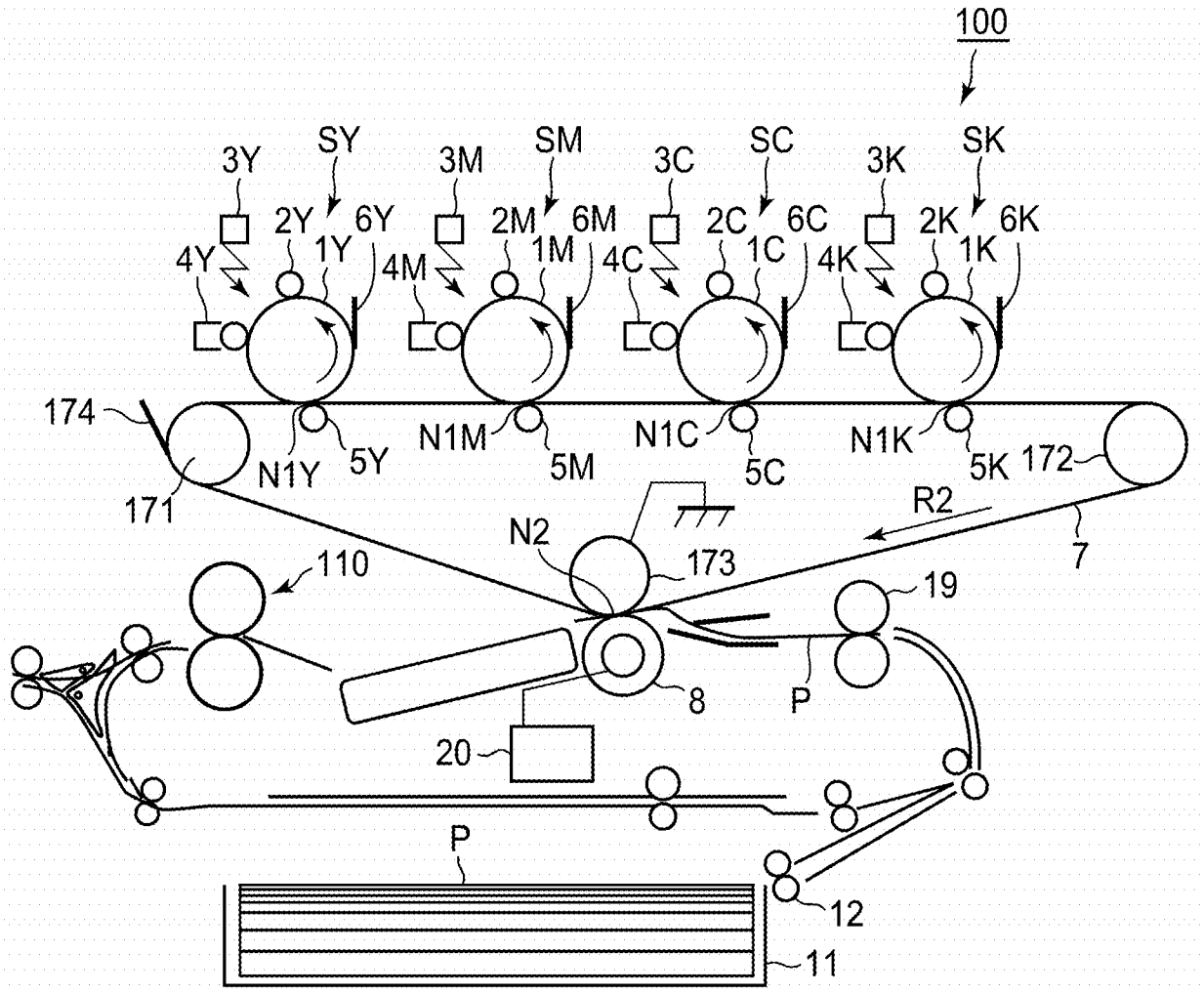
FIG. 8 is a schematic structural view of an image forming apparatus.

FIG. 8 is a schematic sectional view of an image forming apparatus 100 of the present invention.

The image forming apparatus 100 in this embodiment is a tandem multi-function machine (having functions of a copying machine, a printer and a facsimile machine) which is capable of forming a full-color image using an electrophotographic type method and which employs an intermediary transfer type method.

The image forming apparatus 100 includes, as a plurality of image forming portions (stations), first to fourth image forming portions SY, SM, SC and SK for forming images of yellow (Y), magenta (M), cyan (C) and black (K). As regards elements of the respective image forming portions SY, SM, SC and SK having the same or corresponding functions or constitutions, suffixes Y, M, C and K for representing the elements for associated colors are omitted, and the elements will be collectively described in some instances. The image forming portion S is constituted by including a photosensitive drum 1, a charging roller 2, an exposure device 3, a developing device 4, a primary transfer roller 5, and a drum cleaning device 6, which are described later.

The image forming portion S includes the photosensitive drum 1 which is a rotatable drum-shaped (cylindrical)

photosensitive member (electrophotographic photosensitive member) as a first image bearing member for bearing a toner image. The photosensitive drum 1 is rotationally driven in an arrow R1 direction (counterclockwise direction). A surface of the rotating photosensitive drum 1 is electrically charged uniformly to a predetermined polarity (negative in this embodiment) and a predetermined potential by the charging roller 2 which is a roller-type charging member as a charging means. The charged photosensitive drum 1 is subjected to scanning exposure to light by the exposure device (laser scanner device) 3 as an exposure means on the basis of image information, so that an electrostatic image (electrostatic latent image) is formed on the photosensitive drum 1.

The electrostatic image formed on the photosensitive drum 1 is developed (visualized) by supplying toner as a developer by the developing device 4 as a developing means, so that a toner image is formed on the photosensitive drum 1. In this embodiment, the toner charged to the same polarity as a charge polarity of the photosensitive drum 1 is deposited on an exposed portion (image portion) of the photosensitive drum 1 where an absolute value of the potential is lowered by exposing to light the surface of the photosensitive drum 1 after the photosensitive drum 1 is uniformly charged (reverse development type). In this embodiment, a normal charge polarity of the toner, which is the charge polarity of the toner during development, is a negative polarity. The electrostatic image formed by the exposure device 3 is an aggregate of small dot images, and a density of the toner image to be formed on the photosensitive drum 1 can be changed by changing a density of the dot images. In this embodiment, the toner image of each of the respective colors has a maximum density of about 1.5-1.7, and a toner application amount per unit area at the maximum density is about 0.4-0.6 mg/cm$^2$.

As a second image bearing member, an intermediary transfer belt 7, which is an intermediary transfer member constituted by an endless belt, is provided so as to be contactable to the surfaces of the four photosensitive drums 1. The intermediary transfer belt 7 is stretched by a plurality of stretching rollers including a driving roller 171, a tension roller 172, and a secondary transfer opposite roller 173. The driving roller 171 transmits a driving force to the intermediary transfer belt 7. The tension roller 172 controls tension of the intermediary transfer belt 7 at a constant value. In this embodiment, the secondary transfer opposite roller 173 functions as an opposing member (opposing electrode) to a secondary transfer roller 8 (described later). The intermediary transfer belt 7 is rotated (circulated or moved) at a feeding speed (peripheral speed) of about 300-500 mm/sec in an arrow R2 direction (clockwise direction) in FIG. 1 by rotational drive of the driving roller 171.

To the tension roller 172, a force such that the intermediary transfer belt 7 is pushed out from an inner peripheral surface side toward an outer peripheral surface side is applied by a force of a spring as an urging means, so that by this force, tension of about 2-5 kg is exerted on the intermediary transfer belt 7 with respect to a feeding direction of the intermediary transfer belt 7. On the inner peripheral surface side of the intermediary transfer belt 7, the primary transfer rollers 5 which are roller-type primary transfer members as primary transfer means are disposed correspondingly to the respective photosensitive drums 1. The primary transfer roller 5 is urged (pressed) toward an associated photosensitive drum 1 through the intermediary transfer belt 7, whereby a primary transfer portion (primary transfer nip) N1 where the photosensitive drum 1 and the intermediary transfer belt 7 contact each other is formed.

The toner image formed on the photosensitive drum 1 is electrostatically primary-transferred by the action of the primary transfer roller 5 onto the rotating intermediary transfer belt 7 at the primary transfer portion T1. During the primary transfer step, to the primary transfer roller 5, a primary transfer voltage (primary transfer bias), which is a DC voltage of an opposite polarity to a normal charge polarity of the toner, is applied from an unshown primary transfer voltage source. For example, during full-color image formation, the color toner images of Y, M, C and K formed on the respective photosensitive drums 1 are successively (primary)-transferred superposedly onto the intermediary transfer belt 7.

On an outer peripheral surface side of the intermediary transfer belt 7, at a position opposing the secondary transfer opposite roller 173, the secondary transfer roller 8 which is a roller-type secondary transfer member as a secondary transfer means is provided. The secondary transfer roller 8 is urged toward the secondary transfer roller 173 through the intermediary transfer belt 7 and forms a secondary transfer portion (secondary transfer nip) N where the intermediary transfer belt 7 and the secondary transfer roller 8 contact each other. The toner images formed on the intermediary transfer belt 7 are electrostatically transferred (secondary-transferred) onto a recording material (sheet, transfer(-receiving) material) P such as paper sandwiched and fed by the intermediary transfer belt 7 and the secondary transfer roller 8 at the secondary transfer portion N2 by the action of the secondary transfer roller 8. The recording material P is typically paper (sheet), but is not limited thereto, and in some instances, synthetic paper formed of a resin material, such as waterproof paper, and a plastic sheet such as an OHP sheet, and a cloth and the like are used. During the secondary transfer step, to the secondary transfer roller 8, a secondary transfer voltage (secondary transfer bias) which is a DC voltage of the opposite polarity to the normal charge polarity of the toner is applied from a secondary transfer voltage source (high voltage source circuit) 20. The recording material P is accommodated in a recording material cassette 11 or the like, and is fed one by one from the recording material cassette 11 by driving a feeding roller pair 12 on the basis of a feeding start signal, and then is fed to a registration belt pair 19. This recording material P is fed toward the secondary transfer portion N2 by being timed to the toner images on the intermediary transfer belt 7 after being once stopped by the registration roller pair 19.

The recording material P on which the toner images are transferred is fed toward a fixing device 110 as a fixing means by a feeding member or the like. The fixing device 110 heats and presses the recording material P carrying thereon unfixed toner images, and thus fixes (melts) the toner images on the recording material P. Thereafter, the recording material P is discharged (outputted) to an outside of an apparatus main assembly of the image forming apparatus 100.

Further, toner (primary transfer residual toner) remaining on the surface of the photosensitive drum 1 after the primary transfer step is removed and collected from the surface of the photosensitive drum 1 by the drum cleaning device 6 as a photosensitive member cleaning means. Further, deposited matters such as toner (secondary transfer residual toner) remaining on the surface of the intermediary transfer belt 7 after the secondary transfer step, and paper powder are removed and collected from the surface of the intermediary transfer belt 7 by a belt cleaning device 174 as an intermediary transfer member cleaning means.

Here, in this embodiment, the intermediary transfer belt 7 is an endless belt having a three-layer structure of a resin layer, an elastic layer and a surface layer from an inner peripheral surface side to an outer peripheral surface side thereof. As a resin material constituting the resin layer, polyimide, polycarbonate or the like can be used. As a thickness of the resin layer, 70-100 μm is suitable. Further, as an elastic material constituting the elastic layer, urethane rubber, chloroprene rubber or the like can be used. As a thickness of the elastic layer, 200-250 μm is suitable. As a material of the surface layer, a material for permitting easy transfer of the toner (image) onto the recording material P at the secondary transfer portion N2 by decreasing a depositing force of the toner onto the surface of the intermediary transfer belt 7 may desirably be used. For example, it is possible to use one or two or more kinds of resin materials such as polyurethane, polyester, epoxy resin and the like. Or, it is possible to use one or two or more kinds of elastic materials such as an elastic material rubber, an elastomer, a butyl rubber and the like. Further, it is possible to use one or two or more kinds of materials of powder or particles such as a material for enhancing a lubricating property by reducing surface energy in a dispersion state in the elastic material, or one or two or more kinds of the power or the particles which are different in particle size and which are dispersed in the elastic material. Incidentally, a thickness of the surface layer may suitably be 5-10 μm. As regards the intermediary transfer belt 7, an electric resistance is adjusted by adding an electroconductive agent for electric resistance adjustment such as carbon black into the intermediary transfer belt 7, so that volume resistivity of the intermediary transfer belt 7 may preferably be $1\times10^{9}$-$1\times10^{14}$ Ω.cm.

Further, in this embodiment, the secondary transfer roller 8 is constituted by including a core metal (base material) and an elastic layer formed with an ion conductive foam rubber (NBR) around the core metal. In this embodiment, the secondary transfer roller 8 is 24 mm in outer diameter and 6.0-12.0 μm in surface roughness Rz. Further, in this embodiment, the electric resistance of the secondary transfer roller 8 is $1\times10^{5}$-$1\times10^{7}$ Ω as measured under application of a voltage of 2 kV in an N/N (23° C./50% RH) environment. Hardness of the elastic layer is about 30-40° in terms of Asker-C hardness. Further, in this embodiment, a dimension (width) of the secondary transfer roller 8 with respect to a longitudinal direction (widthwise direction) (i.e., a length of the secondary transfer roller 8 with respect to a direction substantially perpendicular to the recording material feeding direction) is about 310-340 mm. In this embodiment, the dimension of the secondary transfer roller 8 with respect to the longitudinal direction is longer than a maximum dimension (maximum width) of widths (lengths with respect to the direction substantially perpendicular to the recording material feeding direction) of the recording materials for which feeding is ensured by the image forming apparatus 100. In this embodiment, the recording material P is fed on the basis of a center (line) of the secondary transfer roller 8 with respect to the longitudinal direction, and therefore, all the recording materials P for which feeding is ensured by the image forming apparatus 100 pass through within a length range of the secondary transfer roller 8 with respect to the longitudinal direction. As a result, it is possible to stably feed the recording materials P having various sizes and to stably transfer the toner images onto the recording materials P having the various sizes.

Figure 9:
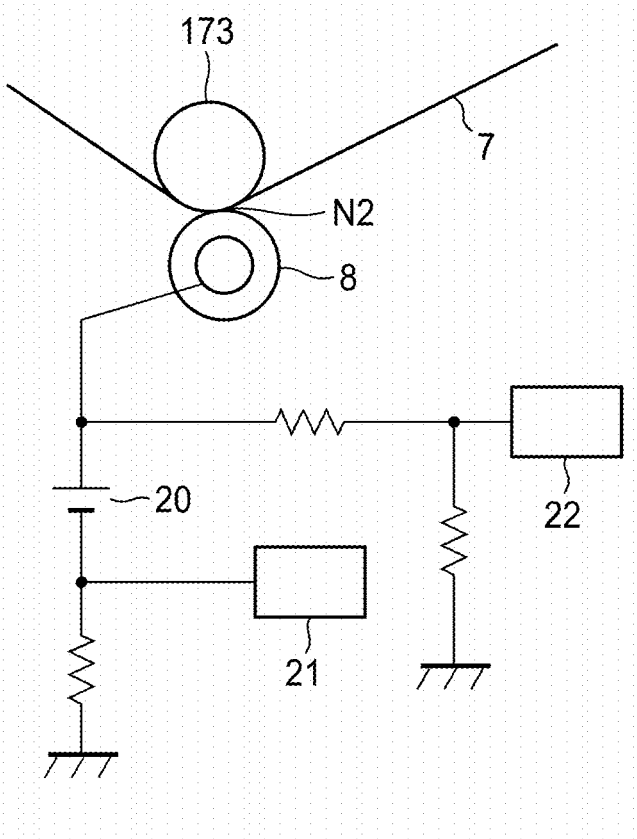
FIG. 9 is a schematic view of a constitution relating to secondary transfer.

FIG. 9 is a schematic view of a constitution regarding the secondary transfer. The secondary transfer roller 8 contacts the intermediary transfer belt 7 toward the secondary transfer opposite roller 173 and thus forms the secondary transfer portion N2. To the secondary transfer roller 8, as an applying means, a secondary transfer voltage source 20 with a variable current voltage value is connected. The secondary transfer opposite roller 173 is electrically grounded (connected to the ground). When the recording material P passes through the secondary transfer portion N2, to the secondary transfer roller 8, a secondary transfer voltage, which is a DC voltage of the opposite polarity to the normal charge polarity of the toner, is applied, so that a secondary transfer current is supplied to the secondary transfer portion N2, and thus the toner image is transferred from the intermediary transfer belt 7 onto the recording material P. In this embodiment, during the secondary transfer, for example, the secondary transfer current of +20 to +80 μA is caused to flow through the secondary transfer portion N2. Incidentally, a constitution in which a roller corresponding to the secondary transfer opposite roller 173 in this embodiment is used as the transfer member and the secondary transfer voltage of the same polarity as the normal charge polarity of the toner is applied to the roller and in which a roller corresponding to the secondary transfer 8 is used as an opposite electrode and is electrically grounded may also be employed.

Figure 10:
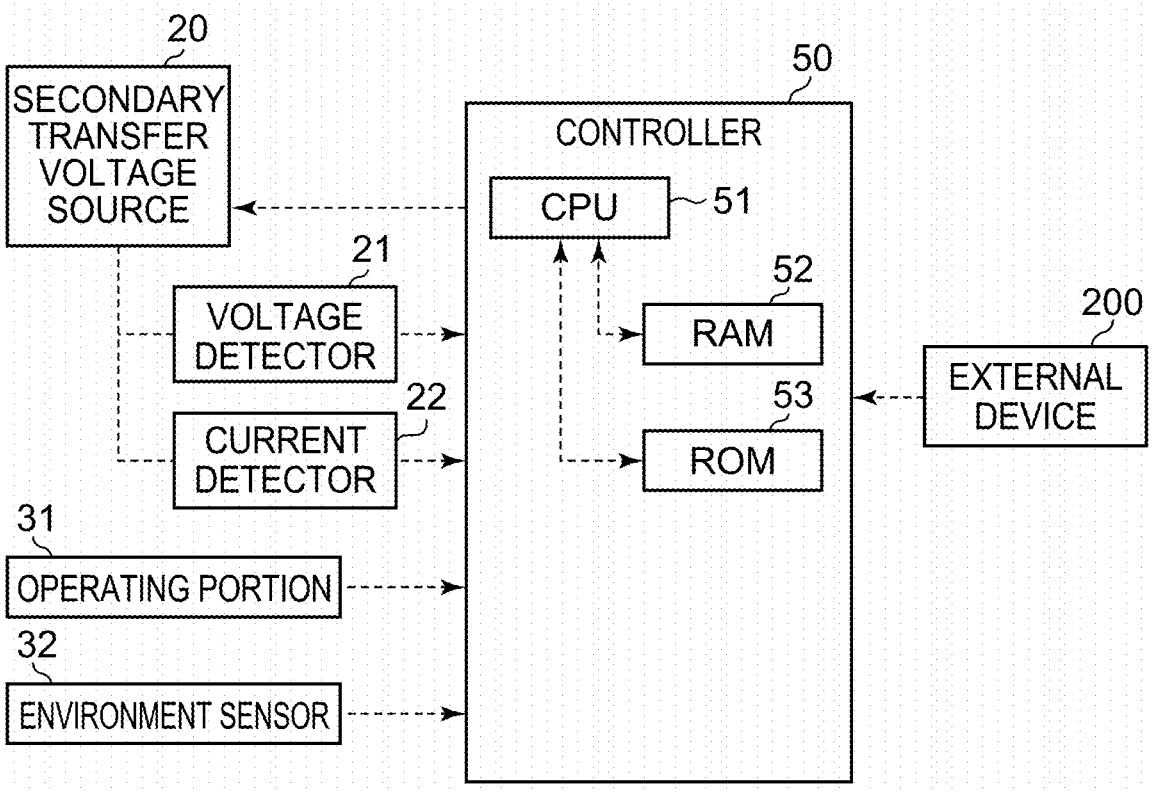
FIG. 10 is a schematic block diagram showing a control mode of a principal part of the image forming apparatus.

In this embodiment, on the basis of information on the electric resistance of the secondary transfer portion N2 (principally the secondary transfer roller 8 in this embodiment) acquired in a state in which the toner image and the recording material P are absent at the secondary transfer portion N2, the secondary transfer voltage to be applied to the secondary transfer roller 8 by the constant-voltage control during the secondary transfer is set. Further, in this embodiment, the secondary transfer current flowing through the secondary transfer portion N2 during the sheet passing is detected. Further, the secondary transfer voltage outputted from the secondary transfer voltage source 20 through the constant-voltage control is controlled so that the secondary transfer current is a predetermined upper limit or less and a predetermined lower limit or more (herein simply referred simply as also a "predetermined current range"). This predetermined current range can be set on the basis of various pieces of information. These various pieces of information may also include the following pieces of information, for example. First, the information is information on a condition designated by an operating portion 31 (FIG. 10) provided in the main assembly of the image forming apparatus 100 or by an external device 200 (FIG. 10) such as personal computer communicatably connected to the image forming apparatus 100. Further, the information is information on a detection result of an environmental sensor 32 (FIG. 10). Further, the information is information on the electric resistance of the secondary transfer portion N2 detected before the recording material P reaches the secondary transfer portion N2. For example, the predetermined current range can be changed on the basis of information on the thickness and the width of the recording material P used in the image formation. Incidentally, the information on the thickness and the width of the recording material P can be acquired on the basis of information inputted from the operating portion 31 or the external device 200. Or, it is also possible to carry out control on the basis of information acquired by a detecting means, provided in the image forming apparatus 100, for detecting the thickness and the width of the recording material P.

In this embodiment, in order to carry out such control, to the secondary transfer voltage source 20, a current detecting circuit 21 as a current detecting means (detecting portion) for detecting a current (secondary transfer current) flowing through the secondary transfer portion N2 (i.e., the secondary transfer voltage source 20 or the secondary transfer roller 8) is connected. Further, to the secondary transfer voltage source 20, a voltage detecting circuit 22 as a voltage detecting means (detecting portion) for detecting a voltage (secondary transfer voltage) outputted from the secondary transfer voltage source 20 is connected. In this embodiment, the secondary transfer voltage source 20, the current detecting circuit 21 and the voltage detecting circuit 22 are provided in the same high-voltage substrate.

2. Control Mode

FIG. 10 is a schematic block diagram showing a control mode of a principal part of the image forming apparatus 100 in this embodiment. A controller (control circuit) 50 is constituted by including a CPU 51 as a control means, which is a dominant element for performing processing, and memories (storing media) such as a RAM 52 and a ROM 53, which are used as storing means. In the RAM 52 which is rewritable memory, information inputted to the controller 50, detected information, a calculation result and the like are stored. In the ROM 53, a data table acquired in advance and the like are stored. The CPU 51 and the memories such as the RAM 52 and the ROM 53 are capable of transferring and reading the data therebetween.

To the controller 50, an image reading device (not shown) provided in the image forming apparatus and the external device 200 such as a personal computer are connected. Further, to the controller 50, the operating portion (operating panel) 31 provided in the image forming apparatus 100 is connected. The operating portion 31 is constituted by including a display portion for displaying various pieces of information to an operator such as a user or a service person by control from the controller 50 and including an input portion for inputting various settings on the image formation and the like by the operator. Further, to the controller 50, the secondary transfer voltage source 20, the current detecting circuit 21 and the voltage detecting circuit 22 are connected. In this embodiment, the secondary transfer voltage source 20 applies, to the secondary transfer roller 8, the secondary transfer voltage which is the DC voltage subjected to the constant-voltage control. Incidentally, the constant-voltage control is control such that a value of a voltage applied to the transfer portion (i.e., the transfer member) is a substantially constant voltage value. Further, to the controller 50, the environmental sensor 32 is connected. The environmental sensor 32 detects a temperature and a humidity in a casing of the image forming apparatus 100. Information on the temperature and the humidity which are detected by the environmental sensor 32 are inputted to the controller 50. The environmental sensor 32 is an example of an environment detecting means for detecting at least one of the temperature and the humidity of at least one of an inside and an outside of the image forming apparatus 100. On the basis of image information from the image reading device or the external device 200 and a control instruction from the operating portion 31 or the external device 200, the controller 50 carries out integrated control of respective portions of the image forming apparatus 100 and causes the image forming apparatus 100 to execute an image forming operation.

Here, the image forming apparatus 100 executes a job (printing operation) which is a series of operations started by a single start instruction (print instruction) and in which the image is formed and outputted on a single recording material P or a plurality of recording materials P. The job includes an image forming step, a pre-rotation step, a sheet (paper) interval step in the case where the images are formed on the plurality of recording materials P, and a post-rotation step in general. The image forming step is performed in a period in which formation of an electrostatic image for the image actually formed and outputted on the recording material P, formation of the toner image, primary transfer of the toner image and secondary transfer of the toner image are carried out, in general, and during image formation (image forming period) refer to this period. Specifically, timing during the image formation is different among positions where the respective steps of the formation of the electrostatic image, the toner image formation, the primary transfer of the toner image and the secondary transfer of the toner image are performed. The pre-rotation step is performed in a period in which a preparatory operation, before the image forming step, from an input of the start instruction until the image is started to be actually formed. The sheet interval step is performed in a period corresponding to an interval between a recording material P and a subsequent recording material P when the images are continuously formed on a plurality of recording materials P (continuous image formation). The post-rotation step is performed in a period in which a post-operation (preparatory operation) after the image forming step is performed. During non-image formation (non-image formation period) is a period other than the period of the image formation (during image formation) and includes the periods of the pre-rotation step, the sheet interval step, the post-rotation step and further includes a period of a pre-multi-rotation step which is a preparatory operation during turning-on of a main switch (voltage source) of the image forming apparatus 100 or during restoration from a sleep state. In this embodiment, during the non-image formation control of setting an initial value of the secondary transfer voltage and control of determining the upper limit and the lower limit (predetermined current range) of the secondary transfer current during sheet passing are carried out.

3. Problem

In the case where the transfer current during sheet passing is detected and then the transfer voltage is controlled, typically, detection of the transfer current and a change of the transfer voltage are carried out. That is, a detection time (first period) in which the transfer current detection is carried out and a response time (second period) form an output of a signal for changing the transfer voltage on the basis of a detection result of the transfer current in the detection time until a response thereof is given are repeated.

Here, there is a time lag from detection that the transfer current is out of the transfer current range until the change of the transfer voltage is ended. For that reason, in a region where the recording material passes through the transfer portion in a period until the change of the transfer voltage is ended and where the transfer current is outside of a proper range, an image defect may occur due to excess and deficiency of the transfer current.

Figure 21:
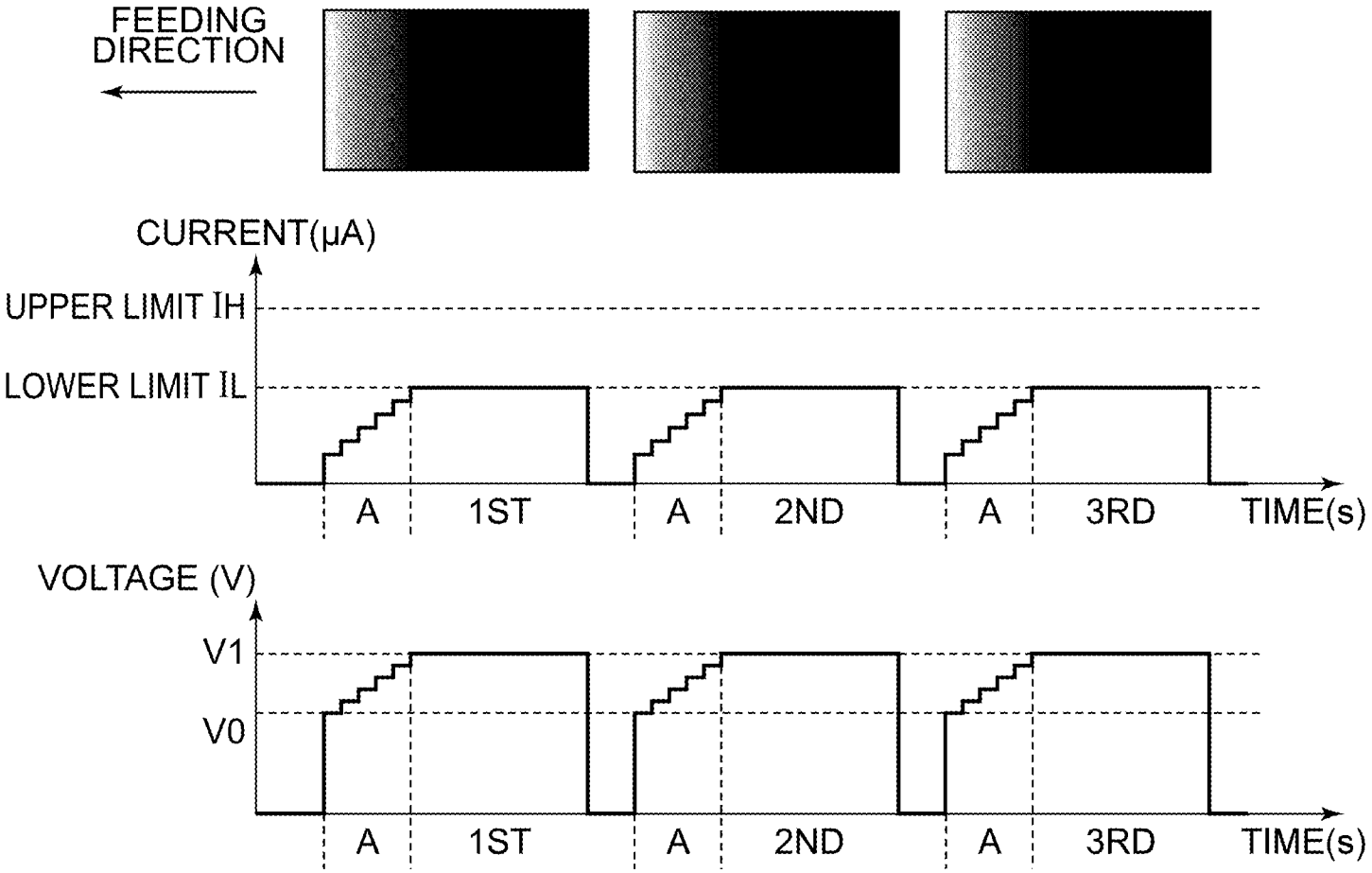
FIG. 21 is a schematic view showing a change of a transfer voltage, a change of a transfer current and an image defect for illustrating a problem.

FIG. 21 schematically shows a change in transfer voltage and transfer current and an occurrence of the image defect when the transfer voltage is changed in the case where the transfer current detected during the sheet passing is below the lower limit. Incidentally, a "leading end" and a "trailing end" refer to the leading end and the trailing end of the recording material with respect to the recording material feeding direction.

As shown in FIG. 21, at a transfer voltage V0 applied to the leading end of the recording material, the transfer current during the sheet passing is I0 and is below a lower limit IL. Therefore, control of gradually increasing the transfer voltage from V0 is carried out so that the transfer current becomes the lower limit IL. As a result, a low image density (transfer void) due to a small transfer current is eliminated, but in a section A, the low image density occurs.

Further, as shown in FIG. 21, in the case where the low image density as described above occurs on a first sheet of the recording materials during continuous image formation, there is a high possibility that a similar low image density occurs also on a subsequent recording material. This is because there is a high possibility that a plurality of recording materials used during the continuous image formation are of the same kind and there is also a high possibility that the recording materials left(-standing) states and the like of the recording materials are substantially the same. Incidentally, in FIG. 21, the image defect due to the deficiency of the transfer current was described as an example, but a similar problem can arise also with regard to the image defect due to the excess of the transfer current.

Thus, it has been required that repetitive occurrence, on the plurality of recording materials, of similar image defects due to the excess and deficiency of the transfer current during the continuous image formation in which the images are continuously formed on the plurality of recording materials.

4. Secondary Transfer Voltage Control

Figure 11:
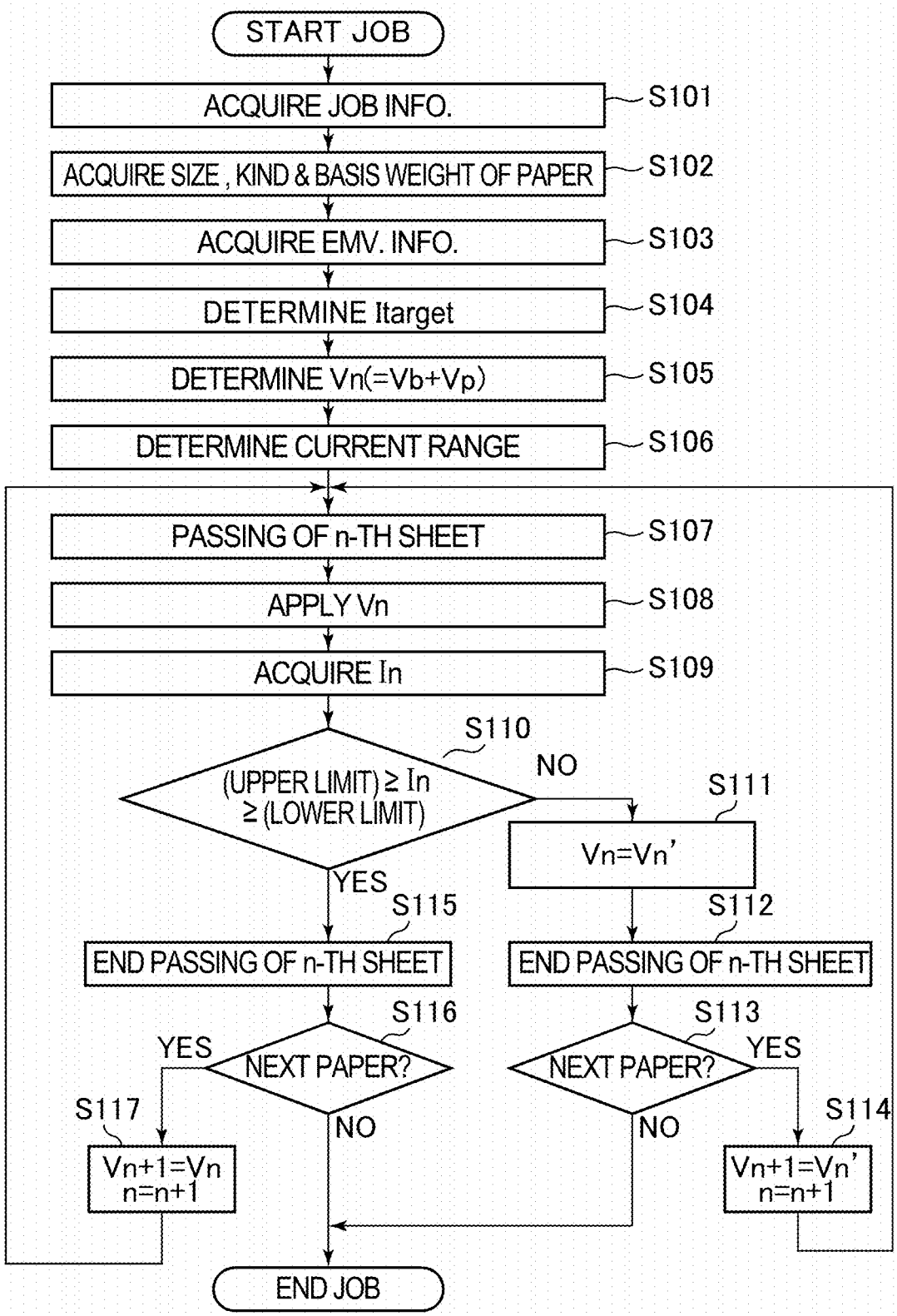
FIG. 11 is a flowchart of control in Embodiment 3.

Next, secondary transfer voltage control in this embodiment will be described. FIG. 11 is a flowchart showing an outline of a procedure of the secondary transfer voltage control in this embodiment. In FIG. 11, of pieces of control executed by the controller 50 when a job is executed, a procedure relating to the secondary transfer voltage control is shown in a simplified manner, and other many pieces of control during the execution of the job is omitted from illustration.

First, when the controller 50 acquires information of the job from the operating portion 31 or the external device 200, the controller 50 causes the image forming apparatus to start the job (S101). In this embodiment, the following pieces of information is included in information on this job. That is, the pieces of information are image information designated by the operator, a size (width, length) of the recording material P on which the image is to be formed, information (paper kind category) relating to a surface property of the recording material P such that whether or not the recording material P is coated paper. The controller 50 causes the RAM 52 to store this information on the job (S102).

Then, the controller 50 acquires environmental information detected by the environmental sensor 32 (S103). Further, in the ROM 53, as shown in FIG. 12, information indicating a correlation between the environmental information and the target current Itarget for transferring the toner image from the intermediary transfer belt 7 onto the recording material P is stored. In this embodiment, this information is set as a table data showing the target current Itarget for each of sections of an ambient water content. This table data has been acquired by an experiment or the like in advance. Incidentally, the controller 50 is capable of acquiring the ambient water content on the basis of the environmental information (temperature, humidity) detected by the environmental sensor 32. The controller 50 acquires the target current Itarget corresponding to the environment from the information indicating the relationship (correlation) between the environmental information and the target current Itarget and causes the RAM 52 to store this information (S104).

Incidentally, the reason why the target current Itarget is changed depending on the environmental information is that a charge amount of the toner changes depending on the environment. The information indicating the relationship between the environmental information and the target current Itarget is acquired by an experiment or the like in advance. Here, the charge amount of the toner is influenced by, in addition to the environment, timing of supplying the toner to the developing device 4 and an operation history such as an amount of the toner coming out of the developing device 4 in some instances. In order to suppress these influences, the image forming apparatus 100 is constituted so that the charge amount of the toner in the developing device 4 is a value which falls within a certain range. However, as a factor other than the environmental information, when a factor affecting the charge amount of the toner on the intermediary transfer belt 7 is known, the target current Itarget may also be changed depending on the information. Further, the image forming apparatus 100 may also be provided with a measuring means for measuring the toner charge amount, and then on the basis of information on the toner charge amount acquired by this measuring means, the target current Itarget may also be changed.

Then, the controller 50 acquires information on the electric resistance of the secondary transfer portion N2 before the recording material P on which the toner image is to be transferred reaches the secondary transfer portion N2, and then sets the secondary transfer voltage on the basis of a result thereof (S105). In this embodiment, the information on the electric resistance of the secondary transfer portion N2 (principally the secondary transfer roller 8 in this embodiment) is acquired by the ATVC, and the secondary transfer voltage is set on the basis of a result thereof. That is, in a state in which the secondary transfer roller 8 and the intermediary transfer belt 7 are brought into contact with each other, a predetermined voltage or a predetermined current is applied from the secondary voltage source 20 to the secondary transfer roller 8. Further, a current value when the predetermined voltage is supplied or a voltage value when the predetermined current is supplied is detected, and a voltage-current characteristic which is a relationship between the voltage and the current is acquired. This relationship between the voltage and the current changes depending on the electric resistance of the secondary transfer portion N2 (principally the secondary transfer roller 8 in this embodiment). For example, in the case where the current does not linearly change relative to the voltage (i.e., the current is not proportional to the voltage), but changes in a manner as represented by a polynomial expression of which order is 2 or more, the predetermined voltage or the predetermined current includes 3 or more levels (values). Then, on the basis of the target current Itarget stored in the RAM 52 in S104 and the acquired voltage-current characteristic, the controller 50 acquires a voltage value Vb necessary to flow the target current Itarget in an absence state of the recording material P in the secondary transfer portion N2. This voltage value Vb corresponds to a secondary transfer portion sharing voltage. Further, in the ROM 53, as shown in FIG. 13, information for acquiring a recording material sharing voltage Vp is stored. In this embodiment, this information is set as a table data showing a relationship between ambient water content and the recording material sharing voltage Vp for each of sections of a basis weight of the recording material P. This table data for acquiring the recording material sharing voltage Vp is acquired by an experiment in advance. Incidentally, the controller 50 is capable of acquiring the ambient water content on the basis of the environmental information (temperature, humidity) detected by the environmental sensor 32. The controller 50 acquires the recording material sharing voltage Vp from the table data on the basis of the information on the basis weight of the recording material P included in the information on the job acquired in S102 and the environmental information acquired in S103. Then, the controller 50 acquires Vb+Vp, which is the sum of the above-described Vb and Vp, as an initial value of a secondary transfer voltage Vn (n represents that the recording material P is an n-th sheet (recording material) and the initial value is 1 in this case) to be applied from the secondary transfer voltage source 20 to the secondary transfer roller 8 during the sheet passing, and this value (Vb+Vp) is stored in the RAM 52. In this embodiment, the initial value of the secondary transfer voltage Vn is acquired until the recording material P reaches the secondary transfer portion N2, and the controller 50 prepares for timing when the recording material P reaches the secondary transfer portion N2.

Incidentally, the recording material sharing voltage (a transfer voltage corresponding to the electric resistance of the recording material P) Vp also changes a surface property of the recording material P as a factor other than the information (basis weight) relating to the thickness of the recording material P. For that reason, the table data may also be set so that the recording material sharing voltage Vp changes also depending on information relating to the surface property of the recording material P. Further, in this embodiment, the information relating to the thickness of the recording material P (and further the information relating to the surface property of the recording material P) are included in the information on the job acquired in S101. However, the image forming apparatus 100 may also be provided with a measuring means for detecting the thickness of the recording material P and the surface property of the recording material P, and on the basis of information acquired by this measuring means, the recording material sharing voltage Vp may also be acquired.

Then, the controller 50 performs a process for determining the upper limit and the lower limit (predetermined current range) of the secondary transfer current during the sheet passing (S106). in the ROM 53, as shown in FIG. 14, information for acquiring a range of a current which may be passed through the secondary transfer portion N2 during the sheet passing from the viewpoint of suppression of the image defect is stored. In this embodiment, this information is set as a table data showing a relationship between the ambient water content, and the upper limit and the lower limit of the current which may be passed through the secondary transfer portion N2 during the sheet passing. This table data is acquired by an experiment or the like in advance. The controller 50 acquires a predetermined current range of the secondary transfer current during the sheet passing from the table data on the basis of the environmental information acquired in S103.

Incidentally, the range of the current which may be passed through the secondary transfer portion N2 during the sheet passing changes depending on the dimension (width) of the recording material P. In FIG. 14, as an example, a table data set on the assumption that the recording material P is paper of 297 mm in dimension (width) corresponding to an A4 size and 90 g/m$^2$ in basis weight. Here, as the current flowing through the transfer portion when the recording material P passes through the secondary transfer portion N2, there are a sheet-passing-portion current and a non-sheet-passing-portion current. The sheet-passing-portion current is a current flowing through a region ("sheet-passing portion") where the recording material P passes through the secondary transfer portion N2 with respect to a direction substantially perpendicular to the feeding direction of the recording material P. Further, the non-sheet-passing-portion current is a current flowing through a region ("non-sheet-passing portion") where the recording material P does not pass through the secondary transfer portion N2 with respect to the direction substantially perpendicular to the recording material feeding direction. A current capable of being detected during the sheet passing is the sum of the sheet-passing-portion current and the non-sheet-portion current. For that reason, every size of the recording material P, a proper predetermined current range of the secondary transfer current passing the sheet passing is acquired in advance, and then the secondary transfer current during the sheet passing is controlled to the predetermined current range, so that the current flowing through the sheet-passing portion can be controlled in a proper range.

Further, from the viewpoint of suppressing the image defect, the range of the current which may be passed through the secondary transfer portion N2 during the sheet passing changes in some instances also depending on a thickness and a surface property of the recording material P as a factor other than the environmental information. For that reason, the table data may also be set so that the range of the current which may be passed through the secondary transfer portion during the sheet passing can be selected depending on information (basis weight) relating to the thickness of the recording material P or information relating to the surface property of the recording material P. Further, the range of the current which may be passed through the secondary transfer portion N2 passing the sheet passing may also be set as a calculation formula. For example, the range of the current which may be passed through the secondary transfer portion N2 during the sheet passing may be determined by a table data or a calculation formula, which designates the range of the current depending on the environmental information, the information (basis weight) relating to the thickness of the recording material P and the information relating to the surface property of the recording material P, which are set for each of sizes of the recording materials P.

Then, when an n-th sheet (n =1 as an initial value) of the recording material P reaches the secondary transfer portion N2 (S107), the controller 50 causes the secondary transfer voltage source 20 to apply a secondary transfer voltage Vn (n=1 as an initial value) to the secondary transfer roller 8 during the sheet passing (S108). Then, the controller 50 acquires a detection result of a secondary transfer current In (n=1 as an initial value) detected by the current detecting circuit 21 during the sheet passing (S109). Then, the controller 50 compares the secondary transfer current In and the predetermined current range determined in S106, and corrects the secondary transfer voltage, outputted from the secondary transfer voltage source 20, as needed (S110, S111). In this embodiment, in the case where the current detected by the current detecting circuit 21 during the sheet passing is out of the predetermined current range, the controller 50 gradually changes the secondary transfer voltage so that the detected current becomes a value in the predetermined current range. This operation is performed by repeating an operation such that the current is detected in a predetermined detection time (first period), and then on the basis of a detection result thereof, the secondary transfer voltage is changed in a predetermined detection time (second period) subsequent to the detection time (first period). Further, this operation is carried out by outputting a signal of changing a voltage current from the controller 50 to the secondary transfer voltage source 20, on the basis of a signal indicating a detection result of the current (inputted from the current detecting circuit 21 in the detection time (first period).

Figure 20:
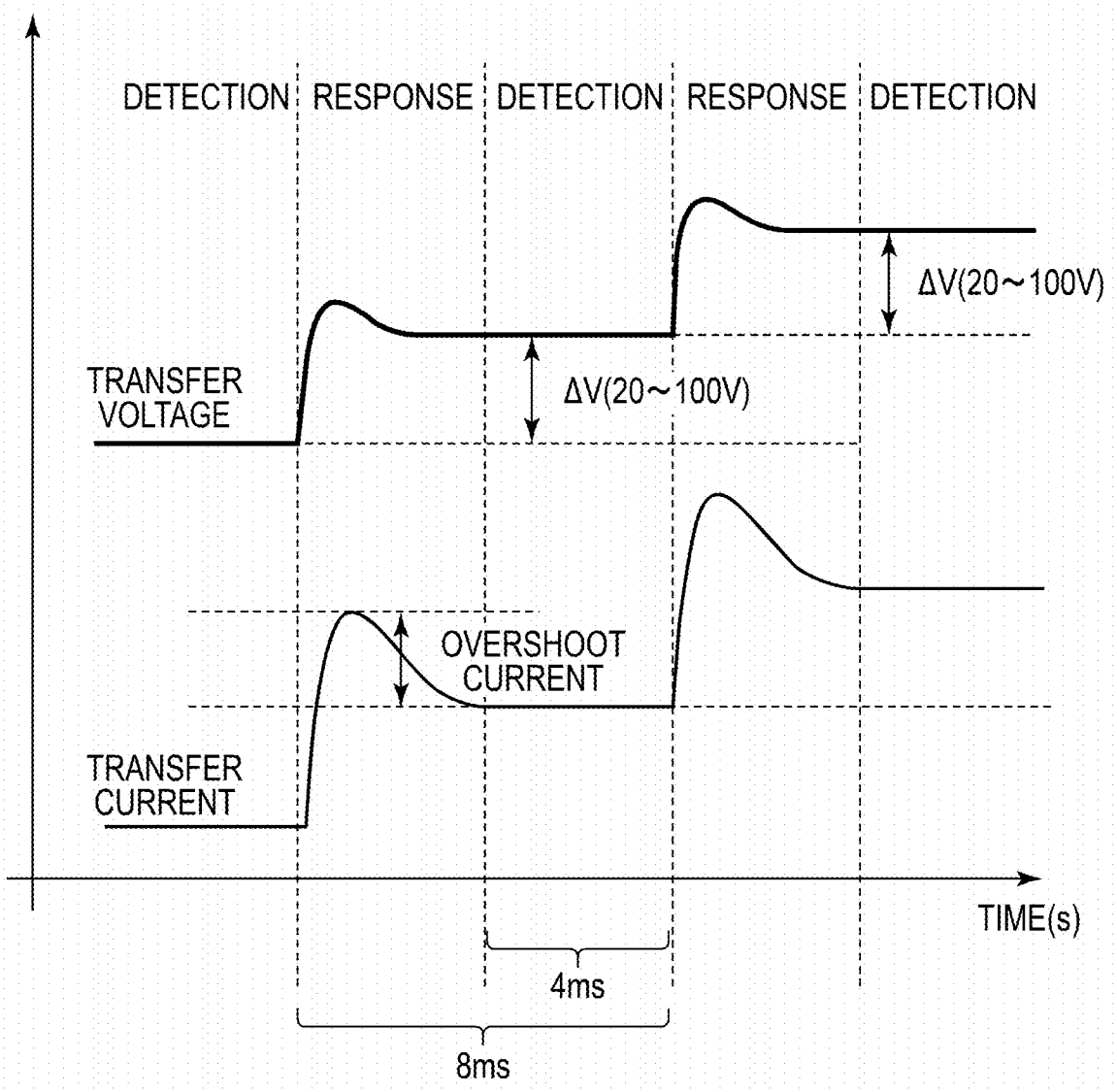
FIG. 20 is a graph for illustrating a changing method of the transfer voltage.

FIG. 20 schematically shows changes of the secondary transfer voltage and the secondary transfer current when the secondary transfer voltage is changed in the case where the secondary transfer current detected during the sheet passing is below the lower limit. As shown in FIG. 20, in the case where the secondary transfer current is still below the lower limit when a predetermined secondary transfer voltage is applied for 8 ms ((response time)+(detection time)), the secondary transfer voltage is changed in the following manner. That is, the secondary transfer voltage is changed to a secondary transfer voltage obtained by adding a predetermined voltage fluctuation range ΔV (100 V in this embodiment) to the predetermined secondary transfer voltage. Further, this change of the secondary transfer voltage is repetitively carried out until the secondary transfer current detected during the sheet passing reaches the lower limit. This is also true for the case where the secondary transfer current detected during the sheet passing exceeds the upper limit, and for example, in the case where the secondary transfer current still exceeds the upper limit when a predetermined secondary transfer voltage is applied for 8 ms ((response time)+(detection time)), the secondary transfer voltage is changed in the following manner. That is, the secondary transfer voltage is changed to a secondary transfer voltage obtained by subtracting a predetermined voltage fluctuation range ΔV (100 V in this embodiment) from the predetermined secondary transfer voltage. Further, this change of the secondary transfer voltage is repetitively carried out until the secondary transfer current detected during the sheet passing reaches the upper limit.

Incidentally, the detection time and the response time may preferably be short to the extent possible since a time (region) in which there is a possibility that the secondary transfer current is out of the predetermined current range and thus the image defect occurs can be reduced. Although the detection time and the response time depend on a performance of the high voltage substrate, each of the detection time and the response time was set at 8 msec. Incidentally, as shown in FIG. 20, in the case where the secondary transfer voltage is changed, when an overshoot such that the secondary transfer voltage once increases up to a value exceeding a target value and then decreases to the target value occurs, an overshoot also occurs in the secondary transfer current. The response time may preferably be set so that the secondary transfer current can be detected after the secondary transfer current converges to a steady state even in the case where such an overshoot occurs.

Thus, in the case where the secondary transfer current detected during the passing of the n-th sheet (n=1 as the initial value) of the recording material P does not fall within the predetermined current range (S110: NO), correction of the secondary transfer voltage Vn to Vn' is made so that the secondary transfer current falls within the predetermined current range (S111). Thereafter, image formation on the n-th recording material P is ended (S112), and when the image is formed on an (n+1)-th recording material P (S113), the following process is carried out. That is, the controller 50 sets a secondary transfer voltage Vn+1 applied to a leading end of the (n+1)-th recording material P at the secondary transfer voltage Vn' after the correction for the n-th recording material P passing the sheet passing (S114). On the other hand, in the case where the secondary transfer current detected during the passing of the n-th (n=1 as the initial value) recording material P falls within the predetermined current range (S110: YES), the correction of the secondary transfer voltage Vn is not made. Thereafter, the image formation on the n-th recording material P is ended (S115), and when the image is formed on the (n+1)-th recording material P (S116), the following process is performed. That is, the controller 50 sets the secondary transfer voltage Vn+1 applied to the leading end of the (n+1)-th recording material P at a voltage value which is substantially the same as the secondary transfer voltage Vn during the passing of the n-th recording material P (S117). Thereafter, when the image formation on all the recording materials Pin the job is ended (S113, S116), the operation of the job is ended.

5. Effect

Figure 15:
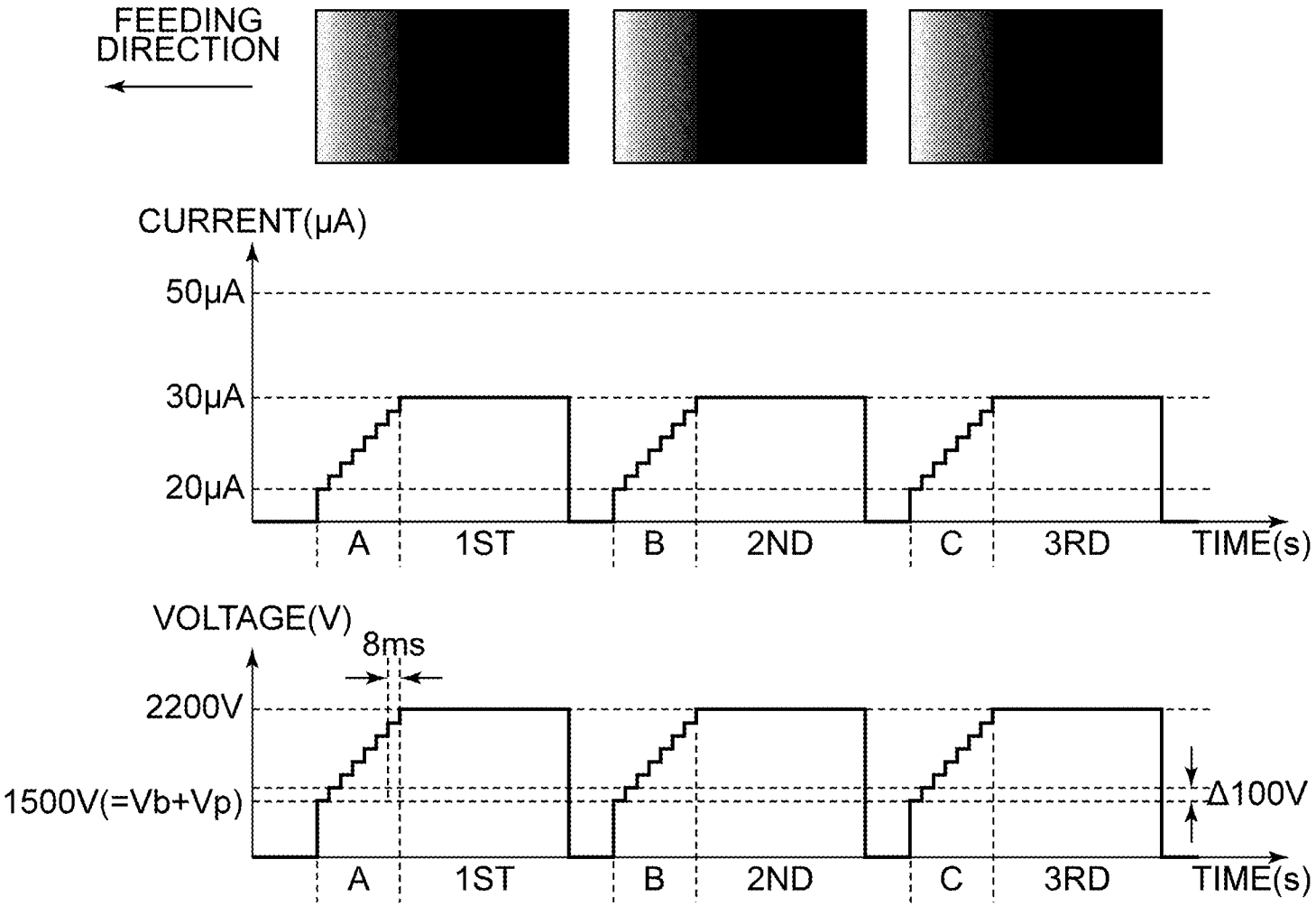
FIG. 15 is a schematic view showing a change of a transfer voltage, a change of a transfer current and an image defect in a comparison example.

FIG. 15 schematically shows changes of the secondary transfer voltage and the secondary transfer current and a state of an occurrence of the image defect in a comparison example in which the secondary transfer voltage control in this embodiment as described above is not carried out. In FIG. 15, an example of the case where continuous image formation is carried out using A4-size paper of 90 g/m$^2$ as the recording material P in an ambient environment (water content: 8.9 g/kg) of 23° C. and 50% RH, and the secondary transfer current detected during the passing of a 1st recording material P is below the lower limit is shown. In this case, the lower limit of the predetermined current range is 30 μA and the upper limit of the predetermined current range is 50 μm (FIG. 14). Further, in this case, the target current Itarget is 40 μA (FIG. 12), and the secondary transfer portion sharing voltage Vb acquired using this target current Itarget is 1000 V. Further, in this case, the recording material sharing voltage Vp is 500 V (FIG. 13), and the initial value of the secondary transfer voltage which is the sum of Vb and Vp is 1500 V. Further, the secondary transfer current detected when the secondary transfer voltage is applied to the leading end of the 1st recording material P is 20 μA. This occurs in the case where as regards the recording materials P when the recording material sharing voltages Vp as shown in FIG. 5 are detected, the basis weight is the same but the electric resistance is extremely high or occurs in the like case.

In the example shown in FIG. 15, the secondary transfer current detected during the passing of the leading end of the 1st recording material P is 20 μA and thus is below 30 μA which is the lower limit. For that reason, the secondary transfer voltage is changed to 1600 V (1500 V+ΔV (=100 V)), and then detection of the secondary transfer current is carried out again. Thereafter, the secondary transfer voltage is changed so as to be increased every secondary transfer voltage ΔV(=100 V) until the secondary transfer current reaches the lower limit. In this example, in the case where the secondary transfer voltage reaches 2200 V, the secondary transfer current is regarded as reaching 30 μA which is the lower limit. That is, in this case, the change of the secondary transfer voltage is executed 7 times. Then, the change of the secondary transfer voltage is stopped after the secondary transfer current reaches the lower limit, and the secondary transfer voltage is kept at 2200 V, and then the secondary transfer bias of the toner image is carried out toward the trailing end of the 1st recording material P.

Thus, in the example of FIG. 15, the image defect due to deficiency of the transfer current occurs in a section A from the leading end of the recording material P where the secondary transfer current is 20 μA to a position where the secondary transfer current reaches 30 μA which is the lower limit.

Further, in this comparison example, as shown in FIG. 15, in the case where the secondary transfer current detected during the passing of the 1st recording material P is below the lower limit during the continuous image formation, there is a high possibility that the secondary transfer current is below the lower limit also during the passing of the 2nd recording material P and later. In the example shown in FIG. 15, during the passing of the leading end of the 2nd recording material P, the secondary transfer voltage of 1500 V similar to the secondary transfer voltage during the passing of the leading end of the 1st recording material P is applied. In this case, during the passing of the leading end of the 2nd recording material P, the secondary transfer current of 20 μA similar to the secondary transfer current during the passing of the leading end of the 1st recording material P is detected. Accordingly, also as regards the 2nd recording material P, similarly as in the case of the 1st recording material P, the image defect due to the deficiency of the transfer current occurs in a section B from the leading end of the recording material P where the secondary transfer current is 20 μA to a position where the secondary transfer current reaches 30 μA which is the lower limit. Similar image defect due to the deficiency of the transfer current is taken over by the 3rd recording material P and later (section C for the 3rd recording material P in FIG. 15).

As shown in FIG. 15, the reason why similar transfer current deficiency occurs for a plurality of recording materials P during the continuous image formation would be considered as follows. That is, there is a high possibility that the plurality of recording materials P used during the continuous image formation are of the same kind. Further, there is a high possibility that the plurality of recording materials P have no large difference in left time after being taken out of packs thereof and have the substantially same water content thereof. That is, there is a high possibility that electric resistances of the recording materials used during the continuous image formation are substantially the same, and therefore, there is a high possibility that in the case where the same transfer voltage is applied, similar transfer current deficiency occurs.

Therefore, in this embodiment, in the case where the secondary transfer current detected during the passing of a certain recording material P in the continuous image formation is out of the predetermined current range and the correction of the secondary transfer voltage is carried out, the secondary transfer voltage applied to the leading end of a subsequent recording material P is determined on the basis of the secondary transfer voltage after the correction. Particularly, in this embodiment, the secondary transfer voltage applied to the leading end of the subsequent recording material P is a voltage value which is the substantially same secondary transfer voltage after the correction. As a result, it is possible to suppress a repetitive occurrence of the image defect due to the transfer current deficiency on the plurality of recording materials P during the continuous image formation.

Figure 16:
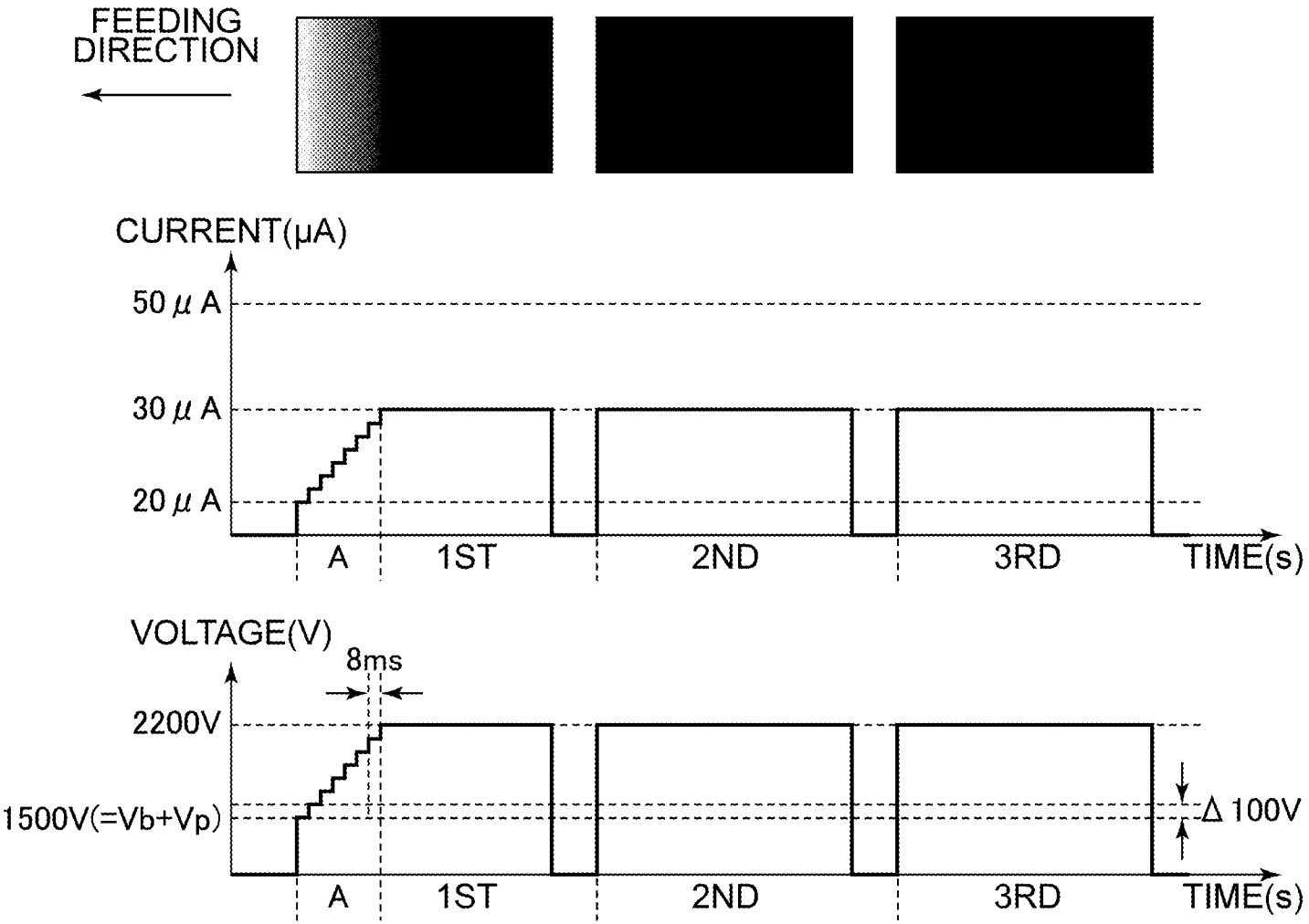
FIG. 16 is a schematic view showing a change of a transfer voltage, a change of a transfer current and an image defect in Embodiment 3.

FIG. 16 is a schematic view similar to FIG. 15 in the case where continuous image formation is carried out in accordance with this embodiment. FIG. 16 shows an example of the case where the continuous image formation is carried out in the same condition as in the comparison example shown in FIG. 15. That is, the example of the case where continuous image formation is carried out using A4-size paper of 90 g/m$^2$ as the recording material P in an ambient environment (water content: 8.9 g/kg) of 23° C. and 50% RH, and the secondary transfer current detected during the passing of a 1st recording material P is below the lower limit is shown. In this case, similarly as in the example of FIG. 15, the lower limit of the predetermined current range is 30 μA and the upper limit of the predetermined current range is 50 μm. The target current Itarget is 40 μA, and the secondary transfer portion sharing voltage Vb is 1000 V. The recording material sharing voltage Vp is 500 V, and the initial value (Vb+Vp) of the secondary transfer voltage is 1500 V. Further, the secondary transfer current detected when the secondary transfer voltage is applied to the leading end of the 1st recording material P is 20 μA. Further, in the example shown in FIG. 16, similarly as in the example shown in FIG. 15, the secondary transfer current detected during the passing of the leading end of the 1st recording material P is 20 μA.

In the example of FIG. 16, as regards the 1st recording material P, behavior similar to the behavior shown in FIG. 15 is exhibited. That is, at the secondary transfer voltage of 1500 V applied to the leading end of the 1st recording material P, the secondary transfer current detected during the sheet passing is 20 μA and thus is below 30 μA which is the lower limit. For that reason, the secondary transfer voltage is changed so as to be gradually increased, and consequently at the time when the secondary transfer voltage after the correction is 2200 V, the detected secondary transfer current reaches 30 μA which is the lower limit.

Then, in this embodiment, as shown in FIG. 16, the secondary transfer voltage applied to the leading end of the 2nd recording material P is determined on the basis of the secondary transfer voltage after the correction during the passing of the 1st recording material P which is a preceding recording material P. Particularly, in this embodiment, the secondary transfer voltage applied to the leading end of the 2nd recording material P is 2200 V (i.e., the secondary transfer voltage applied to the trailing end of the 1st recording material P) which is the secondary transfer voltage after the correction during the passing of the 1st recording material P which is the preceding recording material P. As a result, the secondary transfer current detected during the passing of the 2nd recording material P reaches 30 μA which is the lower limit, from the leading end of the 2nd recording material P. Accordingly, it is possible to suppress the occurrence of the image defect due to the transfer current deficiency on the leading end side of the 2nd recording material P as in the example shown in FIG. 15.

Similarly, also as regards the secondary transfer voltage applied to the leading end of the 3rd recording material P and later, the secondary transfer voltage applied during the sheet passing of an associated preceding recording material P (i.e., the secondary transfer voltage applied to the trailing end of the preceding recording material P) is taken over. As a result, also as regards the 3rd recording material P and later, it is possible to suppress the occurrence of the image defect due to the transfer current deficiency on the leading end side of each of the recording materials P.

Thus, in this embodiment, in the case where the correction of the secondary transfer voltage is carried out so that the secondary transfer current detected during the sheet passing falls within the predetermined current range, the secondary transfer voltage applied to the leading end of a subsequent recording material P is determined on the basis of the secondary transfer voltage after the correction. Particularly, in this embodiment, the secondary transfer voltage applied to the leading end of the subsequent recording material P is a voltage value which is the substantially same secondary transfer voltage after the correction. As a result, it is possible to suppress the occurrence of the image defect due to the excess and deficiency of the secondary transfer current on many recording materials P during the continuous image formation.

Incidentally, in FIG. 16, the case where the secondary transfer current is below the lower limit is described as an example, but similar control can be carried out also in the case where the secondary transfer current exceeds the upper limit. For example, at the secondary transfer voltage applied to the leading end of the 1st recording material P, the secondary transfer current detected during the sheet passing exceeds the upper limit in some instances. In this case, the secondary transfer voltage is changed so as to be gradually decreased, so that a finally detected secondary transfer current reaches the upper limit. Further, the secondary transfer voltage applied to the leading end of the 2nd recording material P is set at the secondary transfer voltage after the correction during the passing of the 1st recording material P (i.e., the secondary transfer voltage applied to the trailing end of the 1st recording material P).

Further, in this embodiment, in the case where the secondary transfer voltage is corrected during the passing of a certain recording material P in the continuous image formation, the secondary transfer voltage applied to the leading end of a subsequent recording material P is a voltage value which is substantially the same as the secondary transfer voltage after the correction, but is not limited thereto. The secondary transfer voltage may only be required to suppress the image defect on the basis of the secondary transfer voltage after the correction. That is, in the case where the secondary transfer current is below the lower limit during the passing of the certain recording material P and then the secondary transfer voltage is corrected so that an absolute value thereof increases, it may only be required that the voltage value is larger in absolute value than the secondary transfer voltage before the correction, which is set so that the secondary transfer current does not exceed the upper limit. Further, in the case where the secondary transfer current exceeds the lower limit during the passing of the certain recording material P and then the secondary transfer voltage is corrected so that an absolute value thereof decreases, it may only be required that the voltage value is smaller in absolute value than the secondary transfer voltage before the correction, which is set so that the secondary transfer current is not below the upper limit.

Further, in this embodiment, the initial value of the secondary transfer voltage applied during the passing of the recording material P is described as being the secondary transfer voltage applied to the leading end of the recording material P, but may only be required to be the secondary transfer voltage applied to a leading end of an image forming region (where the toner image is capable of being transferred). Similarly, in this embodiment, the secondary transfer voltage (including the secondary transfer voltage after the correction) applied during the passing of the preceding recording material P is described as the secondary transfer voltage applied to the trailing end of each of the recording materials P, but may only be required to be the secondary transfer voltage applied to a trailing end of the image forming region.

Further, in this embodiment, in the case where the secondary transfer voltage is corrected during the passing of the certain recording material P in the continuous image formation, the secondary transfer voltage applied to the leading end of the recording material P passed immediately after the certain recording material P is determined on the basis of the secondary transfer voltage after the correction, but is not limited thereto. For example, in view of a relationship with a change or the like of another control, the secondary transfer voltage may also be determined, on the basis of the secondary transfer voltage after the correction, from the secondary transfer voltage applied to the leading end of the recording material P passed after the recording material P passed immediately after the correction (for example, the recording material P subsequent to the recording material passed immediately after the correction). Further, a first recording material P for which there is a possibility that the secondary transfer voltage is corrected during the sheet passing in the continuous image formation is not limited to the 1st recording material P in the continuous image formation. In the case where the secondary transfer voltage is corrected during passing of any first recording material P in the continuous image formation, the secondary transfer voltage applied to the leading end of a second recording material P passed after the first recording material P can be determined.

Thus, the image forming apparatus 100 according to this embodiment includes the detecting means 21 for detecting the current flowing through the transfer portion N2. Further, the image forming apparatus 100 includes the control means 50 which not only subjects the transfer voltage to the constant-voltage control with the predetermined voltage value but also is capable of changing the transfer voltage so that the current detected by the detecting means 21 falls within the predetermined current range. Further, in the case where the transfer voltage is changed when the first recording material P passes through the transfer portion N2 during the continuous image formation in which the images are continuously formed on the plurality of recording materials P, the control means 50 determines the initial value of the transfer voltage during passing, through the transfer portion N2, of the second recording material P passing through the transfer portion N2 after the first recording material P, on the basis of the transfer voltage after the change when the first recording material P passes through the transfer portion N2. In this embodiment, in the case where the control means 50 changes the transfer voltage so that an absolute value thereof increases when the first recording material P passes through the transfer portion N2, the control means 50 sets an initial value of the transfer voltage during passing of the second recording material P through the transfer portion N2 at a voltage value larger in absolute value than the transfer voltage during passing of the first recording material P through the transfer portion N2.

Further, in the case where the control means 50 changes the transfer voltage so that an absolute value thereof decreases when the first recording material P passes through the transfer portion N2, the control means 50 can set an initial value of the transfer voltage during passing of the second recording material P through the transfer portion N2 at a voltage value smaller in absolute value than the transfer voltage during passing of the first recording material P through the transfer portion N2. In this embodiment, the control means 50 sets the initial value of the transfer voltage during passing of the second recording material P through the transfer portion N2 at the voltage value which is substantially the same as the transfer voltage after the above-described change during passing of the first recording material P through the transfer portion N2. Further, in this embodiment, in the case where during the continuous image formation, the control means 50 does not change the transfer voltage during passing of a certain recording material through the transfer portion N2, the control means 50 sets the initial value of the transfer voltage during passing of a subsequent recording material P through the transfer portion N2 at the voltage value which is substantially the same as the transfer voltage during passing of the certain recording material P through the transfer portion N2.

As described above, according to this embodiment, during the continuous image formation, it is possible to suppress that similar image defects, due to the excess and deficiency of the secondary transfer current, occurring in a period until the secondary transfer current falls within the predetermined current range repetitively occur.

[Embodiment 2]

Next, another embodiment of the present invention will be described. Basic constitutions and operations of an image forming apparatus in this embodiment are the same as those of the image forming apparatus of Embodiment 3. Accordingly, in the image forming apparatus of this embodiment, elements having the same or corresponding functions or constitutions as those in Embodiment 3 are represented by the same reference numerals or symbols as those in Embodiment 3 and will be omitted from detailed description.

In Embodiment 3, in the case where the correction of the secondary transfer voltage is made during passing of the certain recording material P in the continuous image formation, as the secondary transfer voltage applied to the leading end of the subsequent recording material P, the voltage value which is substantially the same the secondary transfer voltage after the correction was employed. On the other hand, in this embodiment, as the secondary transfer voltage applied to the leading end of the subsequent recording material P, a voltage value obtained by multiplying the secondary transfer voltage after the correction during passing of the preceding recording material P by a predetermined coefficient is employed.

Incidentally, in Embodiment 3, the case where the continuous image formation was carried out using the A4-size paper of 90 g/m$^2$ as the recording material P in the ambient environment (water content: 8.9 g/kg) of 23° C. and 50% RH was described as an example. On the other hand, in this embodiment, the case where the ambient environment of the image forming apparatus 100 is an extremely dry ambient environment such as an ambient environment (water content: 0.88 g/kg) of 23° C. and 5% RH will be described as an example.

Figure 17:
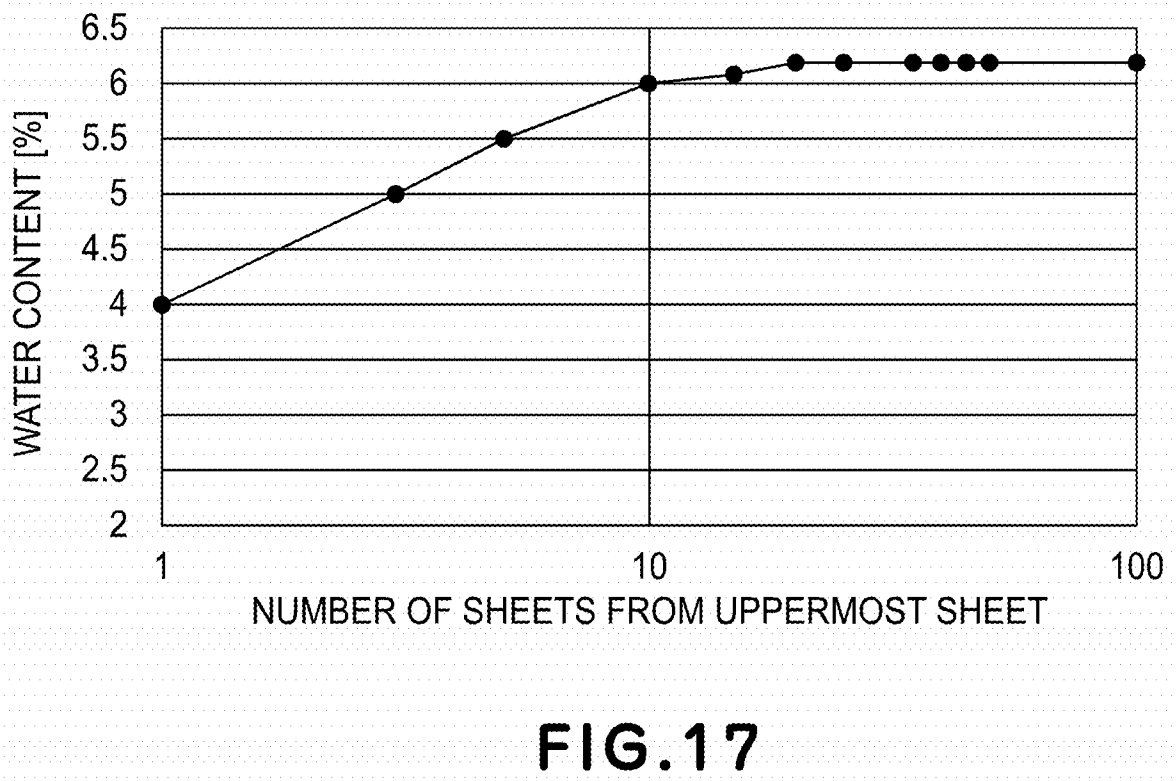
FIG. 17 is a graph showing an example of a water content of a recording material in a recording material cassette.

In the extremely dry ambient environment such as the ambient environment of 23° C. and 5% RH, in a bundle of recording materials (sheets) P accommodated in the recording material cassette 11, water content is largely different between an uppermost recording material P and a recording material P positioned at a center of the bundle with respect to a stacking direction in some instances. FIG. 17 is a graph showing the water content of the paper one by one from the upper-most paper of the bundle of the sheets of paper (recording materials P) accommodated in the recording material cassette 11. In this embodiment, as an example, the case where a left time of the sheets of paper from accommodation in the recording material cassette 11 is 2.5 hours is shown. As shown in FIG. 17, the water content is 4.0% for the uppermost paper, 5.5% for 5-th paper from the uppermost paper, 6.0% for 10-th paper from the uppermost paper, 6.2% for 20-th paper from the uppermost paper, and 6.2% for 100-th paper from the uppermost paper. That is, as regards the water content of the paper of the paper bundle in the recording material cassette 11 in the extremely dry ambient environment, the water content is largely different among those for the uppermost paper, the 5-th paper and the 10-th paper, and there is substantially no difference among those for the 10-th paper and later sheets paper. Incidentally, the water content of each of the sheets of paper immediately after the above-described paper bundle is taken out of a pack is 6.2% which is the same as the water content of the 20-th and later sheets of paper.

Accordingly, in this embodiment, in an environment such that large unevenness in water content of the recording material P in the bundle of the recording materials P accommodated in the recording material cassette 11, the following secondary transfer voltage control is carried out. That is, in this embodiment, the secondary transfer voltage applied to the leading end of a subsequent recording material in the case where the correction of the secondary transfer voltage is made during passing of a certain (preceding) recording material is set at a voltage value obtained by multiplying the secondary transfer voltage after the correction by a predetermined coefficient. Particularly, in this embodiment, the coefficient such that a correction range from the secondary transfer voltage before the correction is decreased is used.

Figure 18:
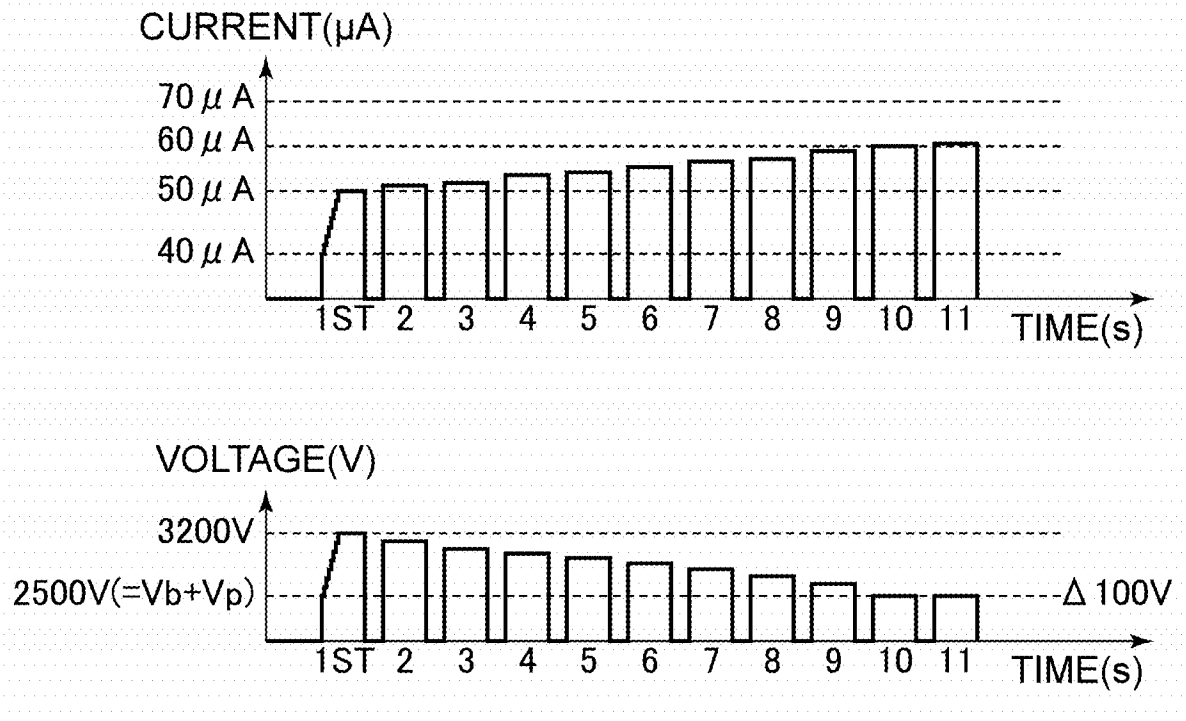
FIG. 18 is a schematic view showing a change of a transfer voltage and a change of a transfer current in Embodiment 4.

FIG. 18 schematically shows a change of the secondary transfer current and a change of the secondary transfer voltage in the case where the continuous image formation is carried out in accordance with this embodiment. In FIG. 18, an example of the case where the continuous image formation is carried out using A4-size paper of 90 g/m$^2$ in basis weight as the recording material P in the ambient environment (water content: 0.88 g/kg) of 23° C. and 5% RH and then the secondary transfer current detected during passing of the first recording material P is below the lower limit is shown. In this case, the lower limit of the predetermined current range is 50 μA and the upper limit of the predetermined current range is 70 μA (FIG. 14). Further, in this case, the target current Itarget is 60 μA (FIG. 12), and the secondary transfer portion sharing voltage Vb acquired using the target current Itarget is 1500 V. Further, in this case, the recording material sharing voltage Vp is 1000 V (FIG. 13), and the secondary transfer voltage which is the sum of Vp+Vb is 2500 V. Further, the secondary transfer current detected when this secondary transfer voltage is applied to the leading end of the first recording material P is 40 μA. Incidentally, a state of the water contents of the recording materials accommodated in the recording material cassette 11 is similar to the state of the water contents described above with reference to FIG. 17.

In the example shown in FIG. 18, at the secondary transfer voltage of 2500 V applied to the leading end of the first recording material P, the secondary transfer current detected during the sheet passing is 40 μA which is below 50 μA being the lower limit. For that reason, the secondary transfer voltage is changed so as to gradually increase similarly as in Embodiment 3, and finally at the time when the secondary transfer voltage after the correction reaches 3200 V, the detected secondary transfer current reaches 50 μA which is the lower limit.

Then, in this embodiment, the secondary transfer voltage applied to the leading end of the second recording material P is set at 3130 V acquired in the following manner. That is, in this embodiment, a difference between the secondary transfer voltage of 2500 V, before the correction, applied to the leading end of the first recording material P and the secondary transfer voltage of 3200 V after the correction during the passing of the first recording material P is 700 V. Further, in this embodiment, a voltage value of 3130 V obtained by adding 630 V which is 9/10 of the difference of 700 V to the secondary transfer voltage of 2500 V before the correction is used as the secondary transfer voltage applied to the leading end of the second recording material P. This is because in this embodiment, in the case where the secondary transfer current detected during the passing of the first recording material P is below the lower limit, the electric resistance of the recording materials P gradually lowers from the first sheet to the 10-th sheet as described above and thus a necessary secondary transfer voltage gradually lowers. Similarly, as regards the secondary transfer voltage applied to the leading end of the third recording material P, a voltage value of 3060 V obtained by adding 560 V which is 8/10 of the difference of 700 V to the secondary transfer voltage of 2500 V before the correction is used as the secondary transfer voltage applied to the leading end of the second recording material P. Also the secondary transfer voltages applied to leading ends of 4-th to 10-th sheets (recording materials P) are similarly decreased gradually, and the secondary transfer voltages applied to leading ends of a 11-th sheet (recording material P) and later sheets (recording materials P) are a voltage value which is substantially the same as the secondary transfer voltage during passing of the 10-th sheet (recording material P).

Figure 19:
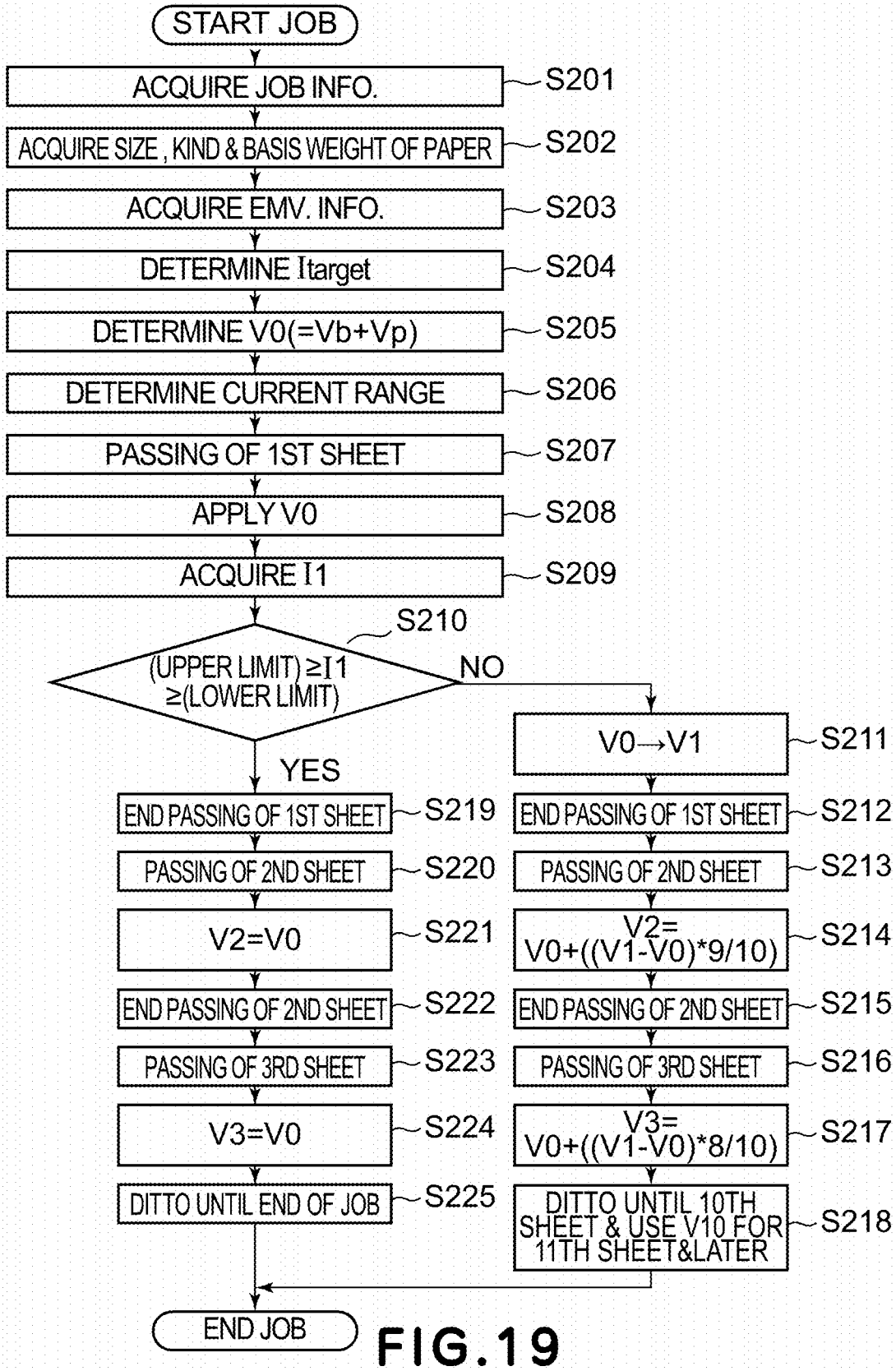
FIG. 19 is a flowchart of control in Embodiment 4.

FIG. 19 is a flowchart showing an outline of an example of a procedure of the secondary transfer voltage control in this embodiment. In this embodiment, the procedure in the case of the example shown in FIG. 18 will be described. Processes of S201 to S210 in FIG. 19 are similar to the procedures of S101 to S110, respectively, in FIG. 11. However, in FIG. 19, the secondary transfer voltage applied to the leading end of the first recording material P is V0, the secondary transfer voltage after the correction during the passing of the first recording material P is V1, and the secondary transfer voltages applied during the passing of the second sheet and later sheets are V2, V3 . . . , respectively.

In the case where the secondary transfer current detected during the passing of the first recording material P does not fall within the predetermined current range (S210: NO), correction of the secondary transfer voltage of V0 to V1 is made so that the secondary transfer current falls within the predetermined current range similarly as in Embodiment 3 (S211). Thereafter, the image formation on the first recording material P is ended (S212), and when the image is formed on the second recording material P (S213), the following process is performed. That is, the controller 50 sets the secondary transfer voltage applied to the leading end of the second recording material P at a secondary transfer voltage V2 acquired from the following formula on the basis of the secondary transfer voltage V0 before the correction during the passing of the first recording material P and the secondary transfer voltage V1 after the correction (S214).

$$V2=V0+((V1-V0)\times 9/10)$$

Thereafter, the image formation on the second recording material P is ended (S215), and when the image is formed on the third recording material P (S216), the following process is performed. That is, the controller 50 sets the secondary transfer voltage applied to the leading end of the third recording material P at a secondary transfer voltage V3 acquired from the following formula on the basis of the secondary transfer voltage V0 before the correction during the passing of the first recording material P and the secondary transfer voltage V1 after the correction (S217).

$$V3=V0+((V1-V0)\times 8/10)$$

Also the secondary transfer voltages applied to the leading ends of the 4-th recording material P to the 10-th recording material P are similarly determined, and are secondary transfer voltages V4 to V10, respectively, acquired from the following formulas. Further, the secondary transfer voltages applied to the leading ends of the 11-th recording material P and later recording materials P are the voltage values which are substantially the same as the secondary transfer voltage during the passing of the 10-th recording material P (S218).

$$V4=V0+((V1-V0)\times 7/10)$$

$$V5=V0+((V1-V0)\times 6/10)$$

$$V6=V0+((V1-V0)\times 5/10)$$

$$V7=V0+((V1-V0)\times 4/10)$$

$$V8=V0+((V1-V0)\times 3/10)$$

$$V9=V0+((V1-V0)\times 2/10)$$

$$V10=V0+((V1-V0)\times 1/10)$$

On the other hand, in the case where the secondary transfer current detected during the passing of the n-th recording material P falls within the predetermined current range (S210: YES), correction of the secondary transfer voltage applied to the leading end of the (n+1)-th recording material P is not made (S219 to S225).

Incidentally, although details are omitted from description in FIG. 19, the controller 50 ends the operation of the job when the image formation all the recording materials P in the job is ended.

Thus, in this embodiment, each of the secondary transfer voltage applied to the leading ends of the second recording material P and later recording materials P during the continuous image formation is made smaller than the secondary transfer voltage during the passing of an associated preceding recording material P depending on an associated correction amount of the secondary transfer voltage during the passing of the first recording material P. As a result, it becomes possible to consider a distribution of the water content of the recording material P in the bundle of the recording materials accommodated in the recording material cassette 11. Particularly, in this embodiment, the water content of the recording material P gradually increases from the uppermost recording material P of the bundle of the recording materials P and is substantially the same as the water content of the recording material P when the bundle of the recording materials P are packed, until the number of the sheets reaches 10. In this embodiment, with respect to such a distribution of the water content of the recording material P in the bundle of the recording materials P accommodated in the recording material cassette 11, it becomes possible to appropriately control the secondary transfer voltage. Accordingly, as regards the first recording material P, the image defect due to the transfer current deficiency can be suppressed, and as regards the second and later recording materials P, it is possible to set proper secondary transfer voltages depending on changes of the water contents of the recording materials.

Incidentally, in this embodiment, the case where the secondary transfer current detected in the extremely dry ambient environment is below the lower limit was described as the example, but it is possible to carry out similar control also in the case where the secondary transfer current detected in, for example, an extremely high-humidity ambient environment. In that case, as regards the recording materials P accommodated in the recording material cassette 11, the water content gradually decreases from the uppermost recording material P toward a lower photosensitive member P and thus the electric resistance of the recording material P gradually increases correspondingly. In order to meet this problem, contrary to this embodiment, the secondary transfer voltages applied to the leading ends of the second and later recording materials P during the continuous image formation may only be required to be made larger than the secondary transfer voltages during passing of associated ones of preceding recording materials P depending on the correction amount of the secondary transfer voltage during the passing of the first recording material P.

Further, the control of the secondary transfer voltage in this embodiment can be carried out in the case where the ambient environment satisfies a predetermined condition. For example, in the case where the water content in the ambient environment is smaller than a predetermined threshold, it is possible to carry out control such that the above-described secondary transfer voltage is gradually decreased. Further, for example, in the case where the water content in the ambient environment is larger than another predetermined threshold, it is possible to carry out control such that the above-described secondary transfer voltage is gradually increased. Further, in the case where the ambient environment does not satisfy the above-described condition, the control described in Embodiment 3 can be carried out.

Thus, in this embodiment, in the case where the controller 50 changes the transfer voltage so that an absolute value thereof increases when the first recording material P passes through the transfer portion N2, the controller 50 sets the initial value of the transfer voltage during the passing of the second recording material P through the transfer portion N2 at the voltage value which is larger in absolute value than the initial value of the transfer voltage during the passing of the first recording material P through the transfer portion N2 and which is smaller in absolute value than the transfer voltage after the change during the passing of the first recording material P through the transfer portion N2. Particularly, in this embodiment, in the case where the controller 50 changes the transfer voltage so that the absolute value thereof increases when the first recording material P passes through the transfer portion N2, the controller 50 sets an initial value of the transfer voltage during passing of each of a plurality of second recording materials successively passing through the transfer portion N2 at a voltage value which is smaller with the initial value of the transfer voltage for the second recording material P which passes through the transfer portion N2 later.

Further, in the case where the controller 50 changes the transfer voltage so that an absolute value thereof decreases when the first recording material P passes through the transfer portion N2, the controller 50 can set the initial value of the transfer voltage during the passing of the second recording material P through the transfer portion N2 at the voltage value which is smaller in absolute value than the initial value of the transfer voltage during the passing of the first recording material P through the transfer portion N2 and which is larger in absolute value than the transfer voltage after the change during the passing of the first recording material P through the transfer portion N2. In this case, when the controller 50 changes the transfer voltage so that the absolute value thereof decreases when the first recording material P passes through the transfer portion N2, the controller 50 can set an initial value of the transfer voltage during passing of each of a plurality of second recording materials successively passing through the transfer portion N2 at a voltage value which is larger with the initial value of the transfer voltage for the second recording material P which passes through the transfer portion N2 later. Further, in this embodiment, the controller 50 sets the initial value of the transfer voltage during the passing of the second recording material P through the transfer portion N2 at a voltage value obtained by multiplying the transfer voltage after the change during the passing of the first recording material P through the transfer portion N2 by the predetermined coefficient.

As described above, according to this embodiment, not only an effect similar to the effect of Embodiment 3 can be obtained but also it is possible to set a proper secondary transfer voltage depending on the change in water content of the recording material P such as in the case where the ambient environment is the extremely dry ambient environment.

(Other Embodiments)

The present invention was described above based on specific embodiments, but is not limited thereto.

The present invention is also similarly applicable to a monochromatic image forming apparatus including only one image forming portion. In this case, the present invention is applied to a transfer portion where the toner image is transferred from the image bearing member such as the photosensitive drum onto the recording material. Further, the present invention can be carried out by arbitrarily combine the respective embodiments.

According to the present invention, it is possible to provide an image forming apparatus in which in the case where the upper limit and the lower limit of the transfer current are set, when the setting of the transfer voltage is changed from the operating portion, the upper limit and the lower limit of the transfer current can be changed depending on the change of the transfer voltage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2018-150893 filed on Aug. 9, 2018 and 2018-215113 filed on Nov. 15, 2018, which are hereby incorporated by reference herein in their entirety.

What is claimed is:

1. An image forming apparatus comprising:

an image forming portion configured to form a toner image;

an intermediate transfer belt to which the toner image formed by the image forming portion is transferred;

an inner roller in contact with the inner surface of the intermediate transfer belt;

a transfer member forming a transfer portion for transferring the toner image from the intermediate transfer belt to the recording material in cooperation with the inner roller;

a voltage source configured to apply a voltage to the transfer portion;

a current detecting portion configured to detect current information on a current flowing through the transfer portion;

a controller configured to control the voltage source, wherein the controller is configured to perform constant voltage control so that the voltage applied from the voltage source becomes a target voltage in a case in which the detection result detected by the current detecting portion is within a predetermined range, which is defined by at least one of an upper limit value and a lower limit value determined based on the type of the recording material during passage of the recording material through the transfer portion, and wherein in a case in which the detection result is out of the predetermined range during passage of the recording material through the transfer portion, the controller is configured to adjust the target voltage so that the detection result falls within the predetermined range, and perform the constant voltage control with the adjusted target voltage; and an operating portion configured to input an instruction from an operator to change the target voltage, wherein the controller is configured to adjust at least one of the upper limit value and the lower limit value of the predetermined range on the basis of the instruction inputted from the operating portion.

2. An image forming apparatus according to claim 1, wherein when the operating portion inputs an instruction to increase an absolute value of the target voltage, the controller increases the upper limit value.

3. An image forming apparatus according to claim 1, wherein when the operating portion inputs an instruction to increase an absolute value of the target voltage, the controller increases the upper limit value and the lower limit value.

4. An image forming apparatus according to claim 1, wherein when the operating portion inputs an instruction to decrease an absolute value of the target voltage, the controller decreases the lower limit value.

5. An image forming apparatus according to claim 1, wherein when the operating portion inputs an instruction to decrease an absolute value of the target voltage, the controller decreases the upper limit value and the lower limit value.

6. An image forming apparatus according to claim 1, wherein the controller determines an amount of a change of the upper limit value or the lower limit value on the basis of an amount of a change of the target voltage.

7. An image forming apparatus according to claim 1, further comprising an acquiring portion configured to acquire environmental information on a temperature or a humidity of an outside or an inside of the image forming apparatus, wherein the controller determines an amount of a change of the upper limit value or the lower limit value on the basis of the environmental information.

8. An image forming apparatus according to claim 7, wherein when an absolute humidity which is acquired by the acquiring portion is a first value, the amount of the change of the upper limit value or the lower limit value per unit change amount of the target voltage is a first change amount, and when the absolute humidity is a second value greater than the first value, the amount of the change of the upper limit value or the lower limit value per unit change amount of the target voltage is a second change amount greater than the first change amount.

9. An image forming apparatus according to claim 1, wherein the controller executes a setting mode for setting a voltage applied by the voltage source when transferring a toner image to a recording material on the basis of the detection result of the current detecting portion when applying a test bias from the voltage source in non-image formation, and determines the change amount of at least one of the upper limit value and the lower limit value on the basis of the test bias and the detection result.

10. An image forming apparatus comprising:

an image forming portion configured to form a toner image;

an intermediate transfer belt to which the toner image formed by the image forming portion is transferred;

an inner roller in contact with the inner surface of the intermediate transfer belt;

a transfer member forming a transfer portion for transferring the toner image from the intermediate transfer belt to a recording material in cooperation with the inner roller;

a voltage source configured to apply a voltage to the transfer portion;

a current detecting portion configured to detect information on a current flowing through the transfer portion; and a controller configured to control the voltage source, wherein the controller is configured to perform constant voltage control so that the voltage applied from the voltage source becomes a target voltage in a case in which a detection result detected by the current detecting portion is within a predetermined range, which is defined by at least one of an upper limit value and a lower limit value determined based on the type of the recording material during passage of the recording material through the transfer portion, and wherein in a case in which the detection result of the current detecting portion is out of the predetermined range during passage of the recording material through the transfer portion, the controller is configured to adjust the target voltage so that the detection result falls within the predetermined range, and perform the constant voltage control with the adjusted target voltage, and wherein in continuous image formation for continuously forming images on a plurality of recording materials, in a case in which the detection result is out of the predetermined range and the target voltage is adjusted during passage of a first recording material through the transfer portion, the controller determines the target voltage to be applied during passage of a leading end portion of a second recording material, which follows the first recording material, through the transfer portion, on the basis of the adjusted target voltage adjusted during passage of the first recording material through the transfer portion.

11. An image forming apparatus according to claim 10, wherein in a case that the absolute value of the target voltage is increased in a first transfer period in which the toner image is transferred to the first recording material, the controller makes the absolute value of the target voltage to be applied during passage of a leading end portion of the second recording material through the transfer portion greater than that in a case that the absolute value of the target voltage is not increased.

12. An image forming apparatus according to claim 10, wherein in a case that the absolute value of the target voltage decreases in a first transfer period in which the toner image is transferred to the first recording material, the controller makes the absolute value of the target voltage to be applied during passage of a leading end portion of the second recording material through the transfer portion less than that in a case that the absolute value of the target voltage is not increased.

13. An image forming apparatus according to claim 10, wherein in a case that the target voltage is changed from a first voltage to a second voltage in a first transfer period in which the toner image is transferred to the first recording material, the controller sets the target voltage to the second voltage when a leading end portion of the second recording material passes through the transfer portion.

14. An image forming apparatus according to claim 10, wherein in a case that the value of the target voltage is not changed when the toner image is transferred to the first recording material, the controller sets the target voltage when the toner image is transferred to the second recording material to the value set when the toner image is transferred to the first recording material.

15. An image forming apparatus according to claim 1, wherein in a case in which the detection result detected by the current detection portion is out of the predetermined range while the recording material passes through the transfer portion, the controller stepwise adjusts the target voltage until the detection result falls within the predetermined range, and performs constant voltage control with the adjusted target voltage.

16. An image forming apparatus according to claim 10, wherein in a case in which the detection result detected by the current detection portion is out of the predetermined range while the recording material passes through the transfer portion, the controller stepwise adjusts the target voltage until the detection result falls within the predetermined range, and performs constant voltage control with the adjusted target voltage.

17. An image forming apparatus according to claim 10, wherein in a case in which the detection result is out of the predetermined range during passage of the second recording material through the transfer portion, the controller is configured to adjust the target voltage set during passage of the second recording material through the transfer portion so that the detection result falls within the predetermined range and perform the constant voltage control with an adjusted target voltage adjusted during passage of the second recording material through the transfer portion.

18. An image forming apparatus according to claim 1, wherein the voltage source is configured to apply the voltage to the inner roller.

19. An image forming apparatus according to claim 10, wherein the voltage source is configured to apply the voltage to the inner roller.

20. An image forming apparatus according to claim 10, wherein the target voltage to be applied during passage of a leading end portion of the first recording material through the transfer portion is a predetermined value based on the type of the first recording material.

21. An image forming apparatus according to claim 10, wherein the target voltage to be applied during passage of a leading end portion of the first recording material through the transfer portion is a predetermined value based on a detection result of the current detection portion when applying a test bias from the voltage source in non-image formation.

* * * * *